US007562866B2

(12) United States Patent
Hayashi

(10) Patent No.: US 7,562,866 B2
(45) Date of Patent: Jul. 21, 2009

(54) SHEET PROCESSING APPARATUS AND IMAGE FORMING APPARATUS

(75) Inventor: Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 11/470,782

(22) Filed: Sep. 7, 2006

(65) Prior Publication Data

US 2007/0060459 A1 Mar. 15, 2007

(30) Foreign Application Priority Data

Sep. 13, 2005 (JP) ..... 2005-265418

(51) Int. Cl.
*B31F 1/10* (2006.01)

(52) U.S. Cl. ..... 270/58.07; 270/20.1; 270/32

(58) Field of Classification Search ..... 270/20.1, 270/32, 58.07; 412/22, 23, 30; 493/406, 493/407, 434

See application file for complete search history.

(56) References Cited

U.S. PATENT DOCUMENTS

| | | | | |
|---|---|---|---|---|
| 6,910,686 | B2 * | 6/2005 | Awano | 270/37 |
| 2006/0263174 | A1 * | 11/2006 | Oikawa et al. | 412/33 |
| 2007/0045919 | A1 * | 3/2007 | Hayashi | 270/32 |
| 2007/0045926 | A1 * | 3/2007 | Fukatsu et al. | 270/58.07 |

FOREIGN PATENT DOCUMENTS

| | | |
|---|---|---|
| JP | 2003-182928 | 7/2003 |
| JP | 2003-341930 | 12/2003 |

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

Provided is a sheet processing apparatus including: a pressing rotation member rotating while pressing a folded sheet bundle; a hold member movable along a fold line of the folded sheet bundle, for holding the pressing rotation member; a common drive source; and a drive transfer member for transferring a drive from the common drive source to the pressing rotation member and the hold member.

8 Claims, 21 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus.

2. Description of the Related Art

Up to now, there are some image forming apparatuses such as a copying machine and a laser beam printer which include a sheet processing apparatus. In the sheet processing apparatus, a discharged sheet is taken therein after an image is formed on the sheet, the sheet is subjected to a binding process in the vicinity of a substantially middle portion of the sheet, and is then subjected to a process such as a half fold to thereby perform saddle stitch binding.

In such the sheet processing apparatus, in a case of performing the saddle stitch binding, a folding process is performed as follows. First, a plurality of sheets conveyed one by one are aligned on a containing tray, the plurality of sheets are subjected to a binding process in the vicinity of middle portions of the sheets, and then the middle portions of the plurality of sheets are collectively inserted into a nip between a pair of folding rollers. Subsequently, a sheet bundle obtained by performing the above-mentioned folding process is discharged toward a lower discharge tray from an outlet provided on a discharge side of the pair of folding rollers with a folded portion being a leading edge.

In some sheet processing apparatuses having a structure described above, a creasing process is further performed with a view to reinforcing the fold line.

For example, in such the sheet processing apparatuses, a plurality of sheets are first aligned in an accumulation part, and then middle portions of the sheets in the conveying direction are stapled, thereby performing the folding process with respect to the sheet bundle by a pair of first folding rollers 83 and 84 shown in FIGS. 20 and 21. Further, the fold line a of a center-folded sheet bundle Sa, which is subjected to the folding process by the pair of first folding rollers 83 and 84, is nipped by a second folding roller 85, and a traveling body 853, which supports the second folding roller 85, is moved in the fold line direction in such the state, thereby reinforcing the fold line a of the center-folded sheet bundle Sa.

It should be noted that, when the second folding roller 85 is being operated, the center-folded sheet bundle Sa is held by the pair of first folding rollers 83 and 84 to render the center-folded sheet bundle Sa immovable. In addition, when traveling on the fold line a, the second folding roller 85 is driven by a motor M4, and a traveling body 853 is driven by a motor M5 (see Japanese Patent Application Laid-Open No. 2003-182928).

However, in the conventional sheet processing apparatus for performing such the folding process, the traveling body 853 and the second folding roller 85 are driven by two different motors M4 and M5, thereby making a structure of the apparatus complicated and increasing a manufacturing cost of the apparatus.

Further, when the fold line a is nipped by the second folding roller 85, the fold line a is nipped in such a manner that the second folding roller 85 moves over the center-folded sheet bundle Sa. Herein, in a case where a movement speed of the traveling body 853 is not set to be equal to a circumferential speed of the second folding rollers 85, a wrinkle or a break occurs in the center-folded sheet bundle Sa, thereby causing a damage such as a trace of a roller on the center-folded sheet bundle Sa. In view of this, it is necessary to make the movement speed of the traveling body 853 equivalent to the circumferential speed of the second folding roller 85. With the structure in which two motors are used, it is necessary to perform a sophisticated control of the traveling body and the roller.

Depending on the number of sheets or the like of the center-folded sheet bundle Sa, there is a possibility that the traveling body 853 is allowed to be reciprocated a plurality of times. In this case, the traveling body 853 changes a direction on the fold line. However, when the traveling body 853 changes the direction on the fold line, in a case where the change of direction by the traveling body 853 and a reverse rotation by the second folding roller 85 are not performed at the same timing, a wrinkle or a break occurs in the center-folded sheet bundle Sa, thereby causing a damage such as a trace of a roller on the center-folded sheet bundle Sa. Also in this case, it is necessary to perform a sophisticated control of the traveling body and the roller to crease the sheet bundle Sa without damaging the center-folded sheet bundle Sa.

SUMMARY OF THE INVENTION

The present invention has been made in view of the above-mentioned situation, and it is therefore an object of the present invention to provide a sheet processing apparatus and an image forming apparatus which are capable of performing a creasing process without damaging a folded sheet, and capable of simplifying structures of the apparatuses and lowering manufacturing costs of the apparatuses.

According to one aspect of the present invention, there is provided a sheet processing apparatus for processing a sheet bundle, including: a pressing rotation member rotating along a fold line of a folded sheet while pressing the fold line of the folded sheet; hold means movable along the fold line of the folded sheet, for holding the pressing rotation member; a common drive source for driving the pressing rotation member and moving the hold means; and drive transfer means for transferring a drive from the common drive source to the pressing rotation member and the hold means, and in the sheet processing apparatus, the drive transfer means is constituted such that a movement speed of the hold means is set to be equal to a circumferential speed of the pressing rotation member.

According to another aspect of the present invention, there is provided a sheet processing apparatus for processing a sheet, including: a pressing rotation member for pressing a fold line of a folded sheet, wherein an axial direction of the pressing rotation member intersects with the fold line of the folded sheet; a holder movable along the fold line of the folded sheet, for rotatably holding the pressing rotation member; a motor; a first drive transfer member for transferring a rotation of the motor to move the holder; and a second drive transfer member for transferring the rotation of the motor to rotate the pressing rotation member.

Further features of the present invention will become apparent from the following description of exemplary embodiments (with reference to the attached drawings).

DESCRIPTION OF THE EMBODIMENTS

Hereinafter, best embodiment modes for carrying out the present invention will be described with reference to the drawings.

Figure 1:
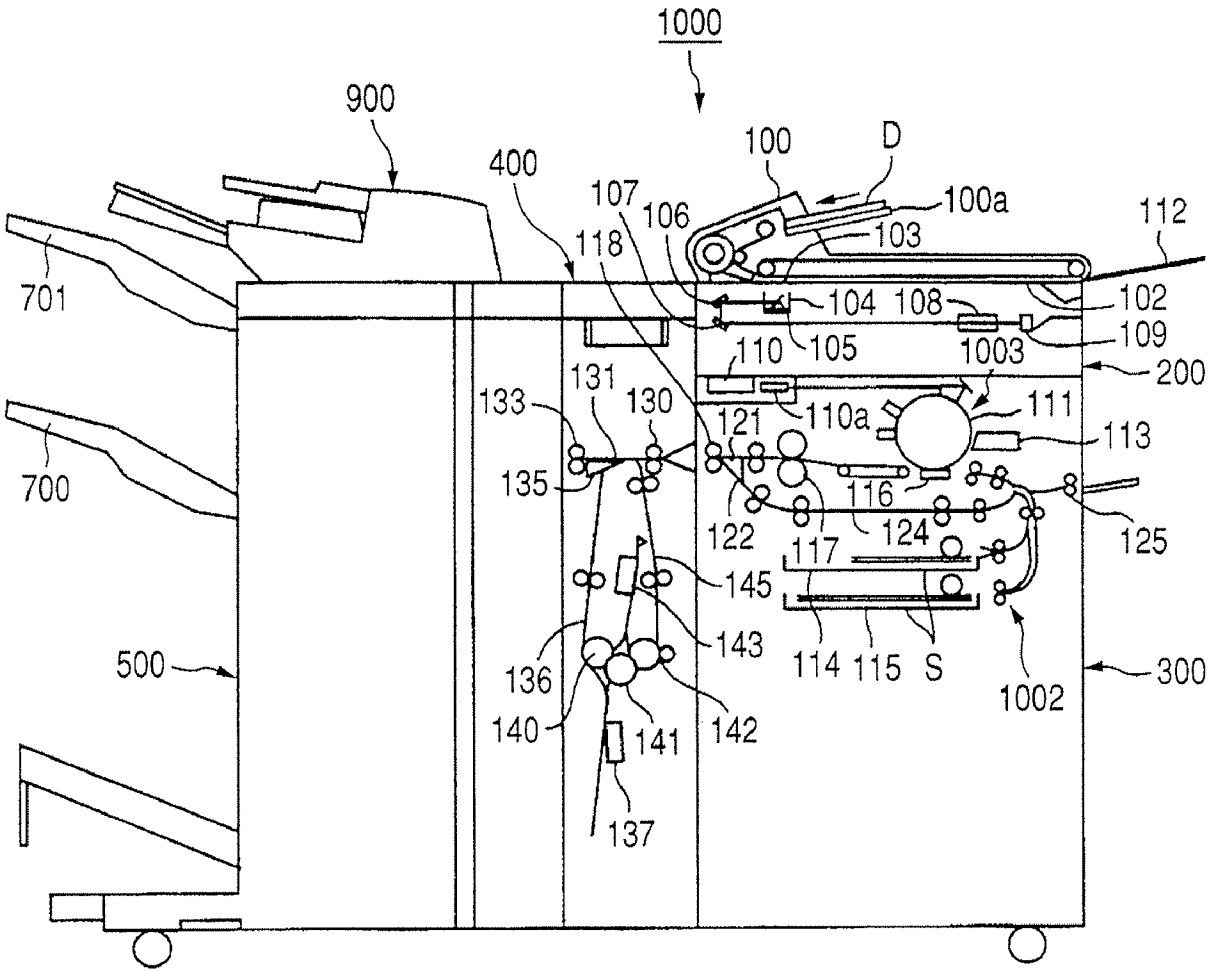
FIG. 1 is a cross-sectional view of a copying machine which is an example of an image forming apparatus including a sheet processing apparatus according to an embodiment of the present invention.

FIG. 1 is a cross-sectional view of a copying machine which is an example of an image forming apparatus including a sheet processing apparatus according to an embodiment of the present invention.

In FIG. 1, a copying machine 1000 includes a copying machine main body 300 and a scanner 200 arranged on an upper surface of the copying machine main body 300.

Here, the scanner 200 for reading a document includes a document feeding portion 100, a scanner unit 104, a lens 108, and an image sensor 109. When a document D is read by the scanner 200, the document D is first set on a tray 100*a* of the document feeding portion 100. At this time, the document D is set in a face-up state in which a surface having an image formed thereon faces upward on the tray 100*a*.

Next, the documents D set in the above-mentioned manner are conveyed by the document feeding portion 100 leftward (i.e., in a direction indicated by the arrow of the figure) one by one in the order from the top page, are conveyed from left to right on a platen glass plate 102 through a curved path, and are then discharged onto a discharge tray 112.

At this time, when the document is read by so-called flow reading, the scanner unit 104 is held at a predetermined position. The document D passes from left to right on the scanner unit 104 to thereby perform a reading process for the document D. In the reading process, upon passing on the platen glass plate 102, the document D is irradiated with light from the lamp 103 of the scanner unit 104. Then, reflected light is guided into the image sensor 109 through mirrors 105, 106, and 107, and the lens 108. The image data of the document D read by the image sensor 109 is subjected to a predetermined image process, and is sent to an exposure control part 110.

On the other hand, in the reading process by so-called fixed-reading, the document D conveyed by the document feeding portion 100 is temporarily stopped on the platen glass plate 102. Then, the scanner unit 104 is allowed to move from left to right on the platen glass plate 102 in such the state, thereby performing the reading process for the document D. In addition, when the reading process for the document D is performed without using the document feeding portion 100, a user lifts up the document feeding portion 100 to set the document D on the platen glass plate 102.

The copying machine main body 300 includes a sheet feeding portion 1002 for feeding a sheet S contained in cassettes 114 and 115, and an image forming portion 1003 for forming an image on the sheet S fed by the sheet feeding portion 1002.

Here, the image forming portion 1003 includes a photosensitive drum 111, a developing device 113, and a transfer charger 116. At the time of image formation, a laser beam from the exposure control part 110 is irradiated on the photosensitive drum to form a latent image on the photosensitive drum. Further, the latent image is visualized and imaged as a toner image by the developing device 113. At a downstream side of the image forming portion 1003, there are arranged a fixing portion 117, discharge rollers 118, and the like.

Next, an image forming operation of the copying machine main body 300 with such the structure will be described.

First, in the flow reading, fixed-reading, or the like performed by the scanner 200 as described above, the image data of the document D read by the image sensor 109 is subjected to the predetermined image process, and is then sent to the exposure control part 110. The exposure control part 110 outputs the laser beam corresponding to the image signal.

Then, the laser beam is irradiated on the photosensitive drum 111 while being scanned by a polygon mirror 110*a*, thereby forming an electrostatic latent image according to the scanned laser beam on the photosensitive drum 111. Subsequently, the electrostatic latent image formed on the photosensitive drum 111 is developed by the developing device 113, thereby visualizing the electrostatic latent image as a toner image.

On the other hand, the sheet S is conveyed from any one of the cassettes 114 and 115, a manual feeding portion 125, and a duplex conveying path 124, to a transferring part constituted of the photosensitive drum 111 and the transfer charger 116. Then, the toner image formed on the photosensitive drum 111, which is visualized in the transferring part, is transferred onto the sheet S. The sheet S onto which the toner image is transferred is subjected to a fixing process in the fixing portion 117.

Next, the sheet S which has passed through the fixing portion 117 is temporarily guided into a path 122 by a flapper 121, and is switched back after a trailing edge of the sheet S has passed through the flapper 121. Then, the sheet S is conveyed to the discharge rollers 118 by the flapper 121, and is then discharged from the copying machine main body 300. As a result, it is possible to discharge the sheet S from the copying machine main body 300 in the state where the surface having the toner image formed thereon faces downward (i.e., face-down).

When the image forming process is performed in the order from the top page by discharging the sheet S in the face-down state by so-called surface reverse discharge as described above, for example, when the image forming process is performed by using the document feeding portion 100 or when the image forming process is performed with respect to the image data sent from a computer, it is possible to align the sheets S in the page order.

When the image forming process is performed with respect to a hard sheet S such as an OHP sheet conveyed from the manual feeding portion 125, the sheet S is discharged from the copying machine main body 300 by the discharge rollers 118 in a state where the surface having the toner image formed thereon faces upward (i.e., face-up) without guiding the sheet S into the path 122.

Further, when the image forming process is performed on both sides of the sheet S, the sheet S is directly guided toward the discharge rollers 118 from the fixing portion 117, is switched back immediately after the trailing edge of the sheet S has passed through the flapper 121, and is guided into the duplex conveying path 124 by the flapper 121.

The copying machine main body 300 includes a folding process part 400 for performing a folding process for the sheet having an image formed thereon which is discharged from the copying machine main body 300, and a finisher 500 serving as a sheet processing apparatus for performing a binding process and a bookbinding process with respect to the sheet.

Next, structures of the folding process part 400 and the finisher 500 will be described.

As shown in FIG. 1, the folding process part 400 includes a conveying path 131 for guiding the sheet discharged from the copying machine main body 300 to the finisher 500 side, and pairs of conveying rollers 130 and 133 on the conveying path 131. Further, in the vicinity of the pair of conveying rollers 133, there is provided a switching flapper 135. The switching flapper 135 is provided so as to guide the sheet conveyed by the pair of conveying rollers 130 into a fold path 136 or to the finisher 500 side.

Here, when the folding process is performed with respect to the sheet S, the switching flapper 135 is switched to the fold path 136 side, thereby guiding the sheet S into the fold path 136. After that, the trailing edge of the sheet S guided into the fold path 136 is allowed to abut against a stopper 137, thereby gradually forming a loop. Then, the loop is folded by the folding rollers 140 and 141. Further, a loop formed by allowing the folded portion to abut against a stopper 143 which is located above the folding rollers 140 and 141 is further folded by the folding roller 141 and a folding roller 142, with the result that the sheet is Z-folded.

The thus Z-folded sheet is conveyed into the conveying path 131 through a conveying path 145, and is discharged to the finisher 500 located at the downstream side by the pair of discharge rollers 133. Meanwhile, in a case where the folding process is not performed, the switching flapper 135 is switched to the finisher 500 side, and the sheet discharged from the copying machine main body 300 is directly fed into the finisher 500 through the conveying path 131.

Figure 2:
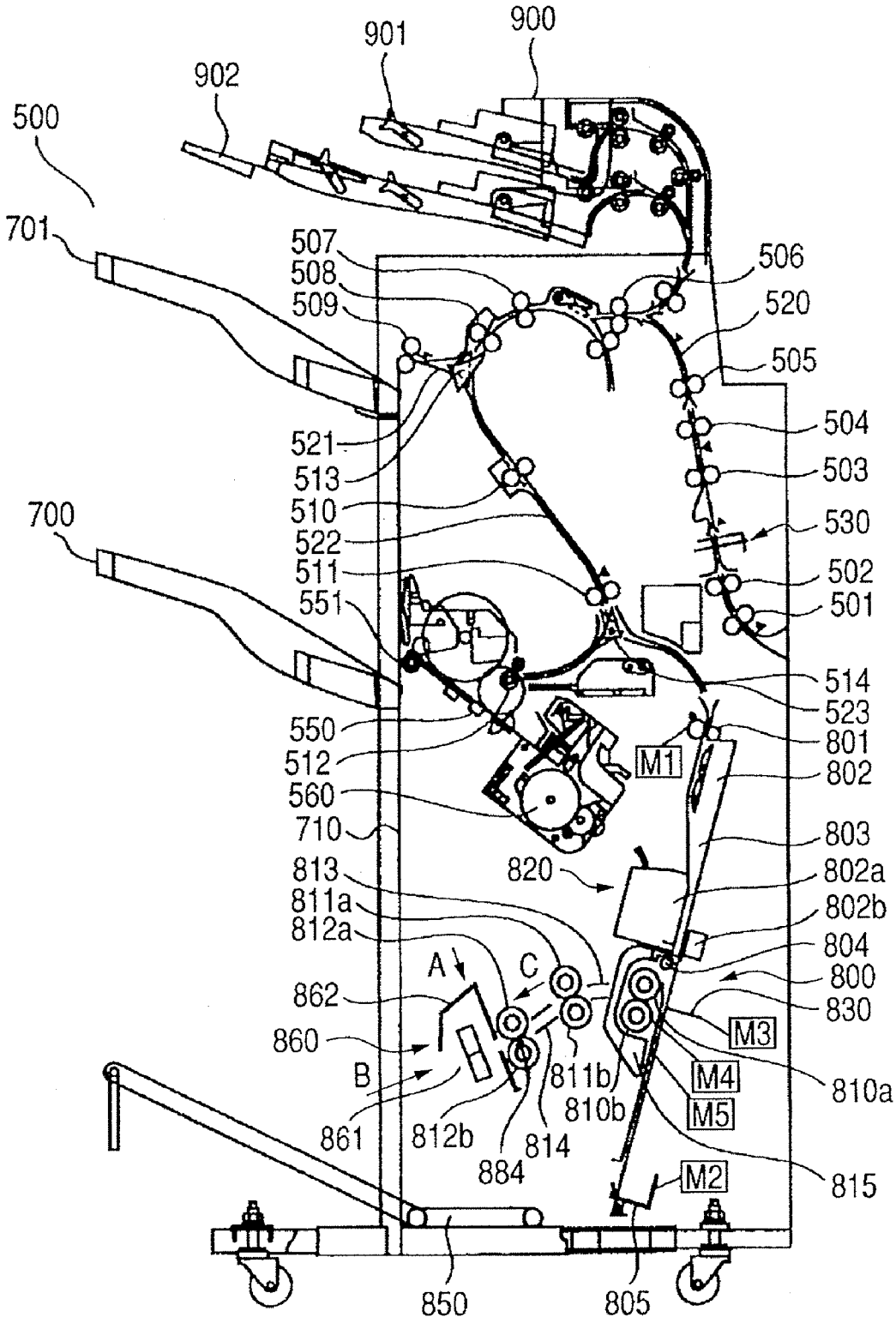
FIG. 2 is a cross-sectional view of a finisher serving as the sheet processing apparatus.

On the other hand, the finisher 500 performs a process for taking therein sheets from the copying machine main body 300 and aligning the plurality of taken sheets to bundle the sheets as one sheet bundle, a sort process, and a non-sort process. Further, the finisher 500 performs a staple process (i.e., binding process) for stapling the sheet bundle on the trailing edge side thereof, a bookbinding process, and the like. As shown in FIG. 2, the finisher 500 includes a stapler 620 for stapling the sheets, and a saddle stitch binding portion 800 serving as a bookbinding processing part for performing bookbinding by folding the sheet bundle in the middle.

In this case, as shown in FIG. 2, the finisher 500 includes a conveying path 520 for taking the sheet, which is discharged through the folding process part 400, into the finisher 500. The conveying path 520 is provided with a pair of entrance rollers 501 and pairs of conveying rollers 502 to 508. Between the pair of conveying rollers 502 and the pair of conveying rollers 503, there is provided a punch unit 530. The punch unit 530 operates according to need and performs a punch process (i.e., boring) in the trailing edge portion of the sheet to be conveyed.

Further, at the end portion of the conveying path 520, there is provided a flapper 513. By the flapper 513, the conveying path is switched to an upper discharge path 521 and a lower discharge path 522 which are connected to each other at a downstream of the flapper 513. Herein, the upper discharge path 521 is provided so as to discharge the sheets onto an upper stack tray by a pair of upper discharge rollers 509. The lower discharge path 522 is provided so as to discharge the sheets onto a process tray 550, and is provided with pairs of conveying rollers 510 to 512.

A switching flapper 514 switches the conveying path to the lower discharge path 522 or a saddle discharge path 523 to be described later. The switching flapper 514 is switched to a position indicated by the solid line, thereby discharging the sheets onto the process tray 550.

Figure 11:
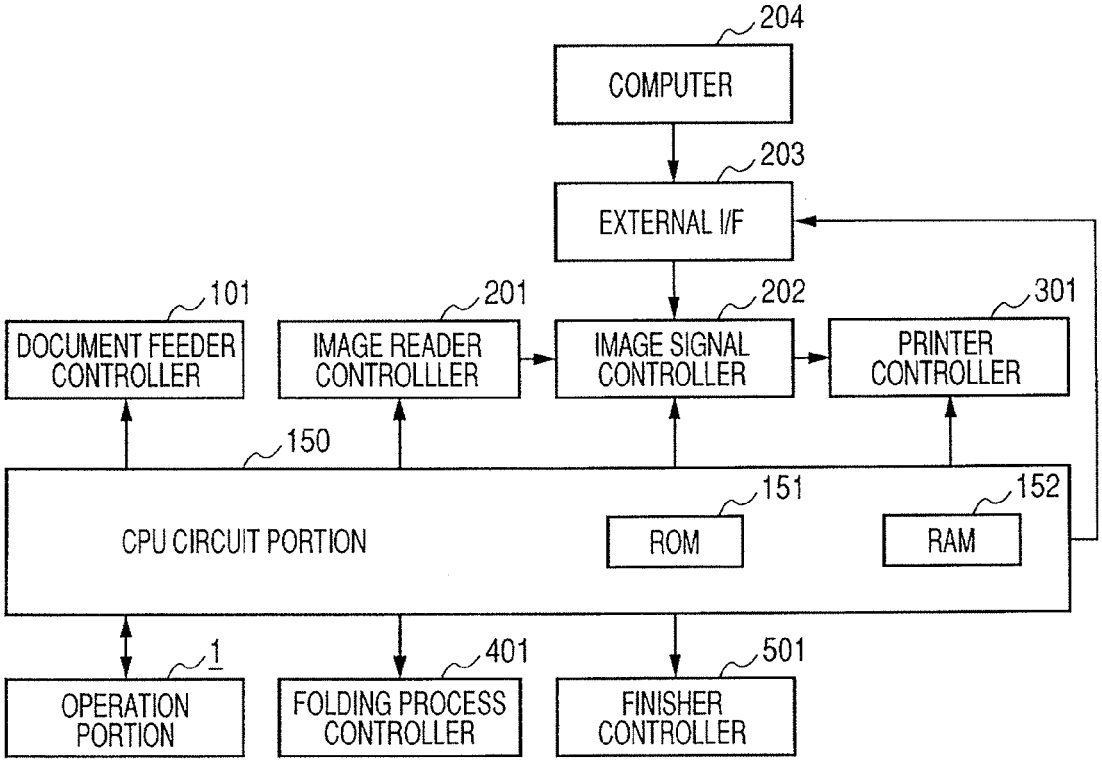
FIG. 11 is a control block diagram of the copying machine.

After the sheets are discharged onto the process tray 550, the sheets are received on the process tray 550 in a bundle shape while being sequentially aligned. Then, the sheets are subjected to the sort process or the staple process according to settings by an operation portion 1 to be described later which is provided in the copying machine main body 300 as shown in FIG. 11. After that, the sheets are discharged onto stack trays 700 and 701 by a pair of bundle discharge rollers 551. Note that the staple process is performed by a stapler 560 which is movable in the width direction and is capable of stapling the sheets in an arbitrary positions of the sheets.

In addition, the stack trays 700 and 701 are structured to be movable in a vertical direction. The upper stack tray 701 may receive the sheets from the upper discharge path 521 and the process tray 550, and the lower stack tray 701 may receive the sheets from the process tray 550. Thus, it is possible to stack a large amount of sheets on the stack trays 700 and 701. The trailing edges of the stacked sheets are regulated by a trailing edge guide 710 which extends in vertical direction, thereby aligning the sheets.

On the other hand, the switching flapper 514 provided halfway in the lower discharge path 522 is switched to a position indicated by the broken line, thereby conveying the sheet to the saddle stitch binding portion 800 through the saddle discharge path 523. In this case, the sheet is first transferred to a pair of saddle entrance rollers 801, and is fed in a containing guide 803 of the saddle stitch binding portion 800 while an inlet is selected by the flapper 802 which is operated by a solenoid according to a size of the sheet.

Then, the sheet thus fed in the containing guide 803 is conveyed before the leading edge of the sheet is brought into contact with a sheet positioning member 805, which is movable in the vertical direction, by a slide roller 804. Note that the pair of saddle entrance rollers 801 and the slide roller 804 are driven by a motor M1.

Further, at a position halfway in the containing guide 803, there is provided a stapler 820 including a driver 802*a* for projecting staples, and an anvil 802*b* for folding the projected staples such that the driver 802*a* and the anvil 802*b* are opposed to each other across the containing guide 803.

Here, in the conveyance of the sheet, the sheet positioning member 805 is stopped at a position where the middle portion of the sheet in the sheet conveying direction becomes a binding position of the stapler 820. Note that the sheet positioning member 805 is movable in the vertical direction by being driven by a motor M2, and is capable of changing positions according to the size of the sheet.

At a downstream side of the stapler 820, there are provided a pair of folding rollers 810*a* and 810*b*, and at a position opposed to the pair of folding rollers 810*a* and 810*b*, there is provided a thrust member 830. The thrust member 830 has a home position which is set at a position behind the containing guide 803, and thrusts toward the contained sheet bundle by being driven by a motor M3.

Thus, the thrust member 830 thrusts toward the sheet bundle, thereby making it possible to push the sheet bundle into a nip between the pair of folding rollers 810*a* and 810*b* to fold the sheet bundle. Note that the thrust member 830 returns to the home position again after pushing the sheet bundle into the nip.

On the other hand, a pressure F1 that is sufficient for creasing the sheet bundle is applied to the nip portion between the pair of folding rollers 810*a* and 810*b*, into which the sheet bundle is pushed. As a result, when the sheet bundle passes through the pair of folding rollers 810*a* and 810*b*, the sheet is creased. After that, the creased sheet bundle is discharged onto a folded bundle discharge tray 850 through a pair of first folding conveying rollers 811*a* and 811*b* and a pair of second folding conveying rollers 812*a* and 812*b*.

Pressures F2 and F3 that are sufficient for conveying and stopping the creased sheet bundle, are also applied respectively on the pair of first folding conveying rollers 811*a* and 811*b* and the pair of second folding conveying rollers 812*a* and 812*b*, each of which are conveying means. The pair of folding rollers 810*a* and 810*b*, the pair of first folding conveying rollers 811*a* and 811*b*, and the pair of second folding conveying rollers 812*a* and 812*b* are rotated at a constant speed by the single motor M4.

In the case of folding the sheet bundle stapled by the stapler 820, the sheet positioning member 805 is allowed to descend from the position where the sheet positioning member 805 is located during the staple process, by a predetermined distance so that the staple position for the sheet bundle is identical with the nip position of the pair of folding rollers 810*a* and 810*b*. As a result, it is possible to fold the sheet bundle with the position subjected to the staple process as a center.

As shown in FIG. 2, a bundle conveying guide 813 connects the pair of folding rollers 810*a* and 810*b* and the pair of first conveying rollers 811*a* and 811*b* to each other, and a bundle conveying guide 814 connects the pair of first folding rollers 811*a* and 811*b* and the pair of second conveying rollers 812*a* and 812*b* to each other.

A pair of alignment plates 815 each have a surface protruding toward the containing guide 803 around outer peripheral surfaces of the pair of folding rollers 810*a* and 810*b*, and aligns the sheets contained in the containing guide 803. Further, the pair of alignment plates 815 are driven by the motor M5 to move in an inserting direction with respect to the sheets, thereby positioning the sheets in the width direction.

An inserter 900 is provided on the upper portion of the finisher 500, and inserts another sheet (i.e., insert sheet) different from an ordinary sheet, as the top page or the last page, or between the sheets on which an image is formed in the printer unit 300, of the sheet bundle.

The inserter 900 joins the sheets set on insert trays 901 and 902 in the conveying path 520 at a desired timing without passing the sheets through the printer unit 300, and conveys the sheets any one of the stack trays 700 and 701 and the containing guide 803.

Meanwhile, at a downstream of the pair of second conveying rollers 812*a* and 812*b*, there is provided a fold-line press unit 860 for reinforcing the fold line of the sheet bundle so that the fold-line press unit 860 spatially overlaps the folded bundle discharge tray 850. Herein, the fold-line press unit 860 includes a pair of press rollers 861 serving as a pressing rotation member which rotates along the fold line of the sheet bundle while pressing the fold line of the folded sheet bundle, and a press holder 862 serving as hold means which supports the pair of press rollers 861. In the state where the pair of press rollers 861 nip the fold line of the sheet bundle, the press holder 862 is allowed to move in the fold line direction, thereby reinforcing the fold line.

Figure 3:
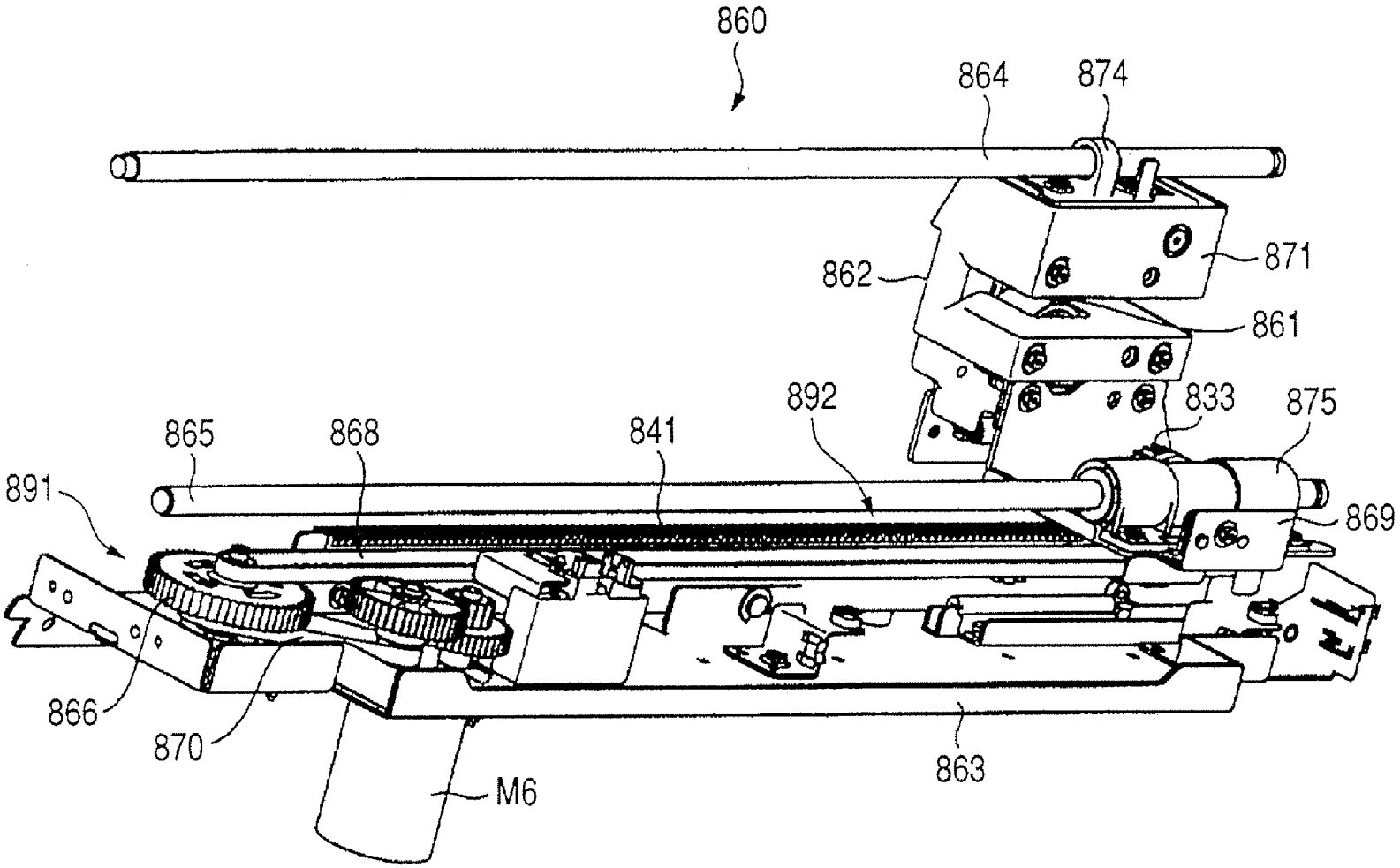
FIG. 3 is a perspective view of a press unit provided to the finisher.
Figure 4:
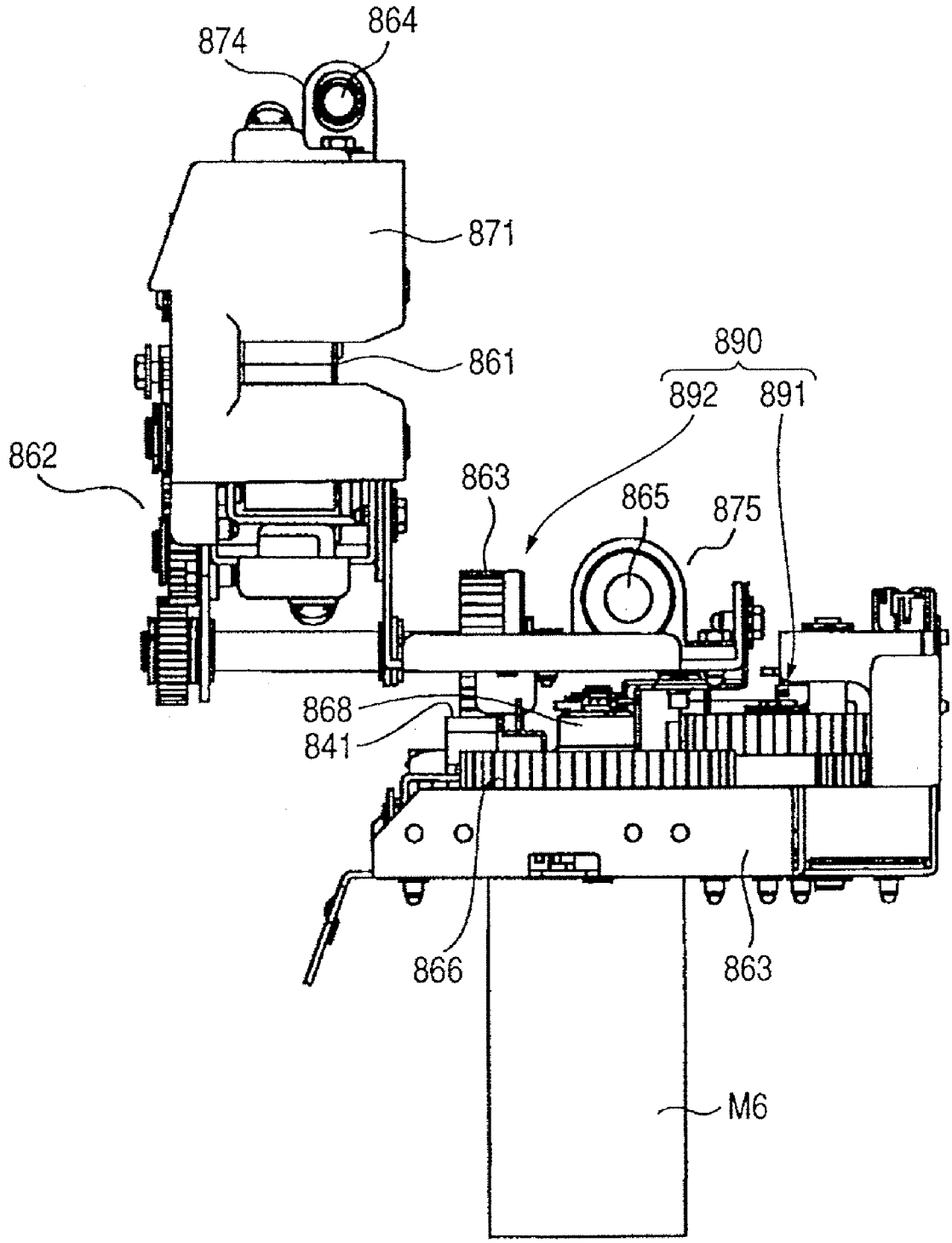
FIG. 4 is a front view of the press unit.
Figure 5:
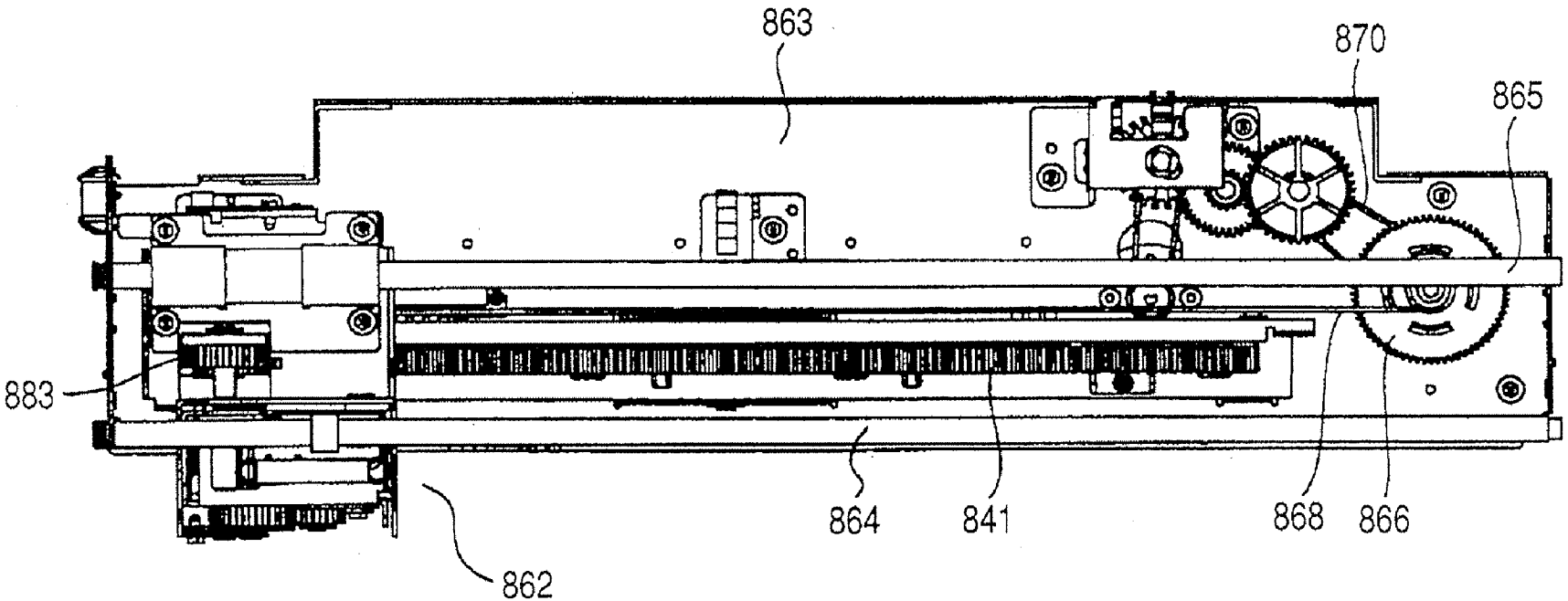
FIG. 5 is a view of the press unit viewed from a direction indicated by the arrow A shown in FIG. 2.
Figure 6:
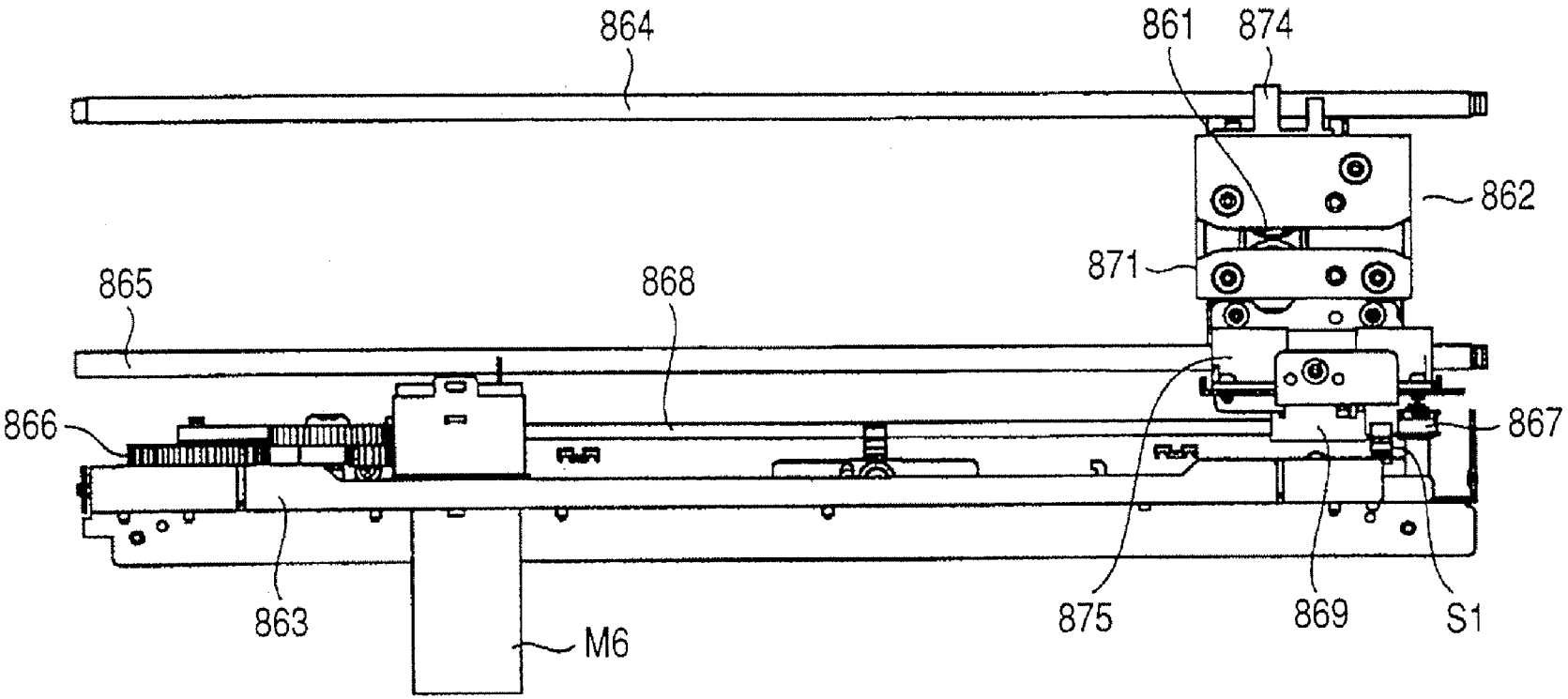
FIG. 6 is a view of the press unit viewed from a direction indicated by the arrow C shown in FIG. 2.

Next, the fold-line press unit 860 will be described with reference to FIGS. 3 to 6. Note that FIG. 3 is a perspective view of the fold-line press unit, FIG. 4 is a front view thereof, FIG. 5 is a view of the fold-line press unit viewed from a direction indicated by the arrow A shown in FIG. 2, and FIG. 6 is a view of the fold-line press unit viewed from a direction indicated by the arrow C shown in FIG. 2.

The fold-line press unit 860 includes a base sheet metal 863 into which major parts of the fold-line press unit 860 are incorporated, and two slide shafts 864 and 865, and is fixed onto front and back side plates. The two slide shafts 864 and 865 are arranged in parallel with each other in backward and forward directions of the finisher 500, and supports the press holder 862 through slide bearings 874 and 875 which are each fixed onto the press holder 862.

In addition, the press holder 862 is fixed to a belt 868 suspending over pulleys 866 and 867 arranged to be rotatable forward and backward with respect to the base sheet metal 863, through a joint sheet metal 869. Further, the pulley 866, that is, one of the pulleys suspended by the belt 868, is suspended by a belt 870, and the belt 870 is driven by a motor M6 mounted on the base sheet metal 863.

With such the structure, the press holder 862 can move in the backward and forward directions of the finisher 500 in accordance with the drive of the motor M6 which is transferred through a first drive transfer part 891 constituted of the pulleys 866 and 867 and the belts 868 and 870.

It should be noted that a home position of the press holder 862 is located at a back side of the finisher 500, and the home position is detected by a home sensor S1 shown in FIG. 6. When the press holder 862 is located at the home position, it becomes possible to discharge the sheet bundle to the folded bundle discharge tray 850 by the pair of second conveying rollers 812*a* and 812*b*.

Figure 7:
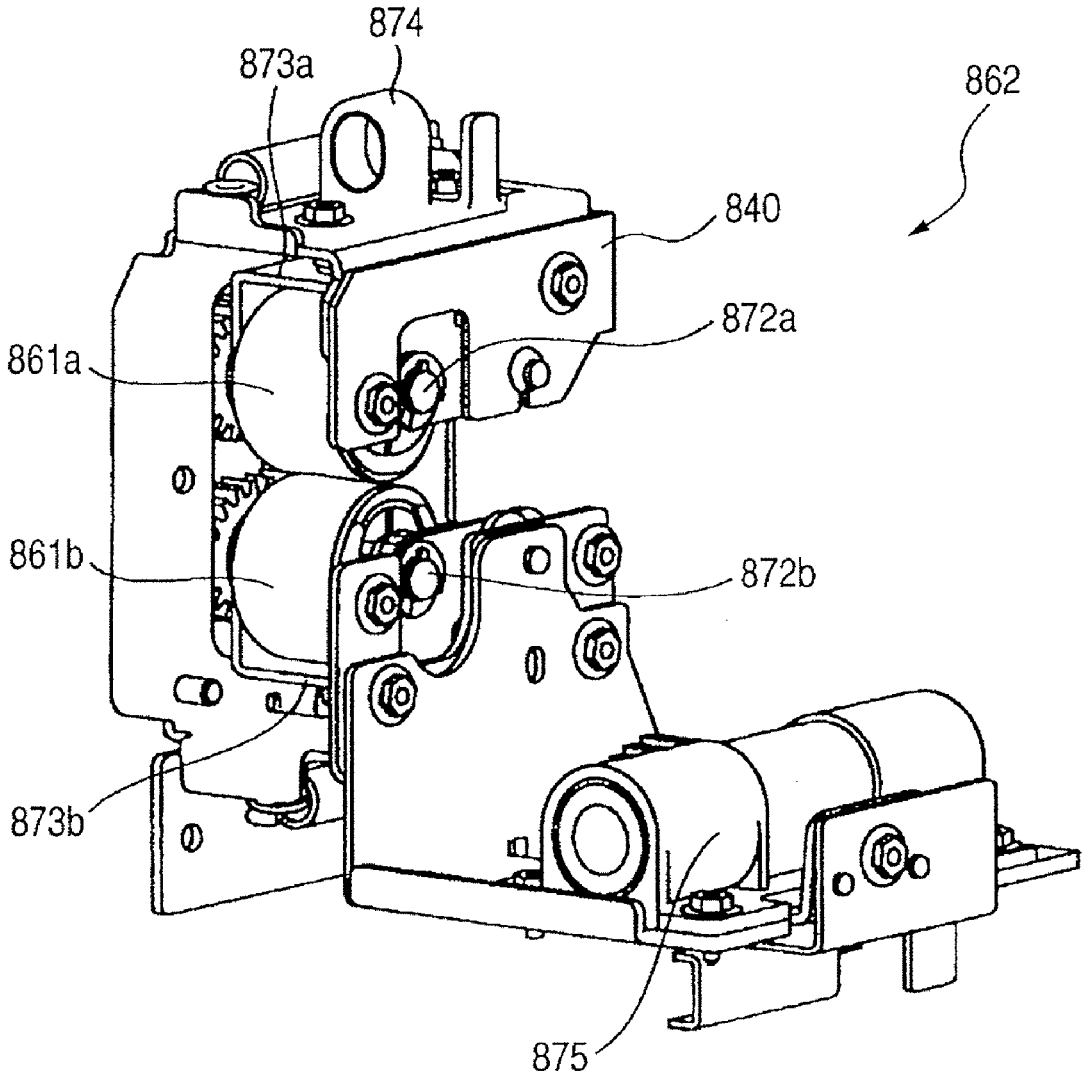
FIG. 7 is a perspective view of a press holder provided to the press unit.
Figure 8:
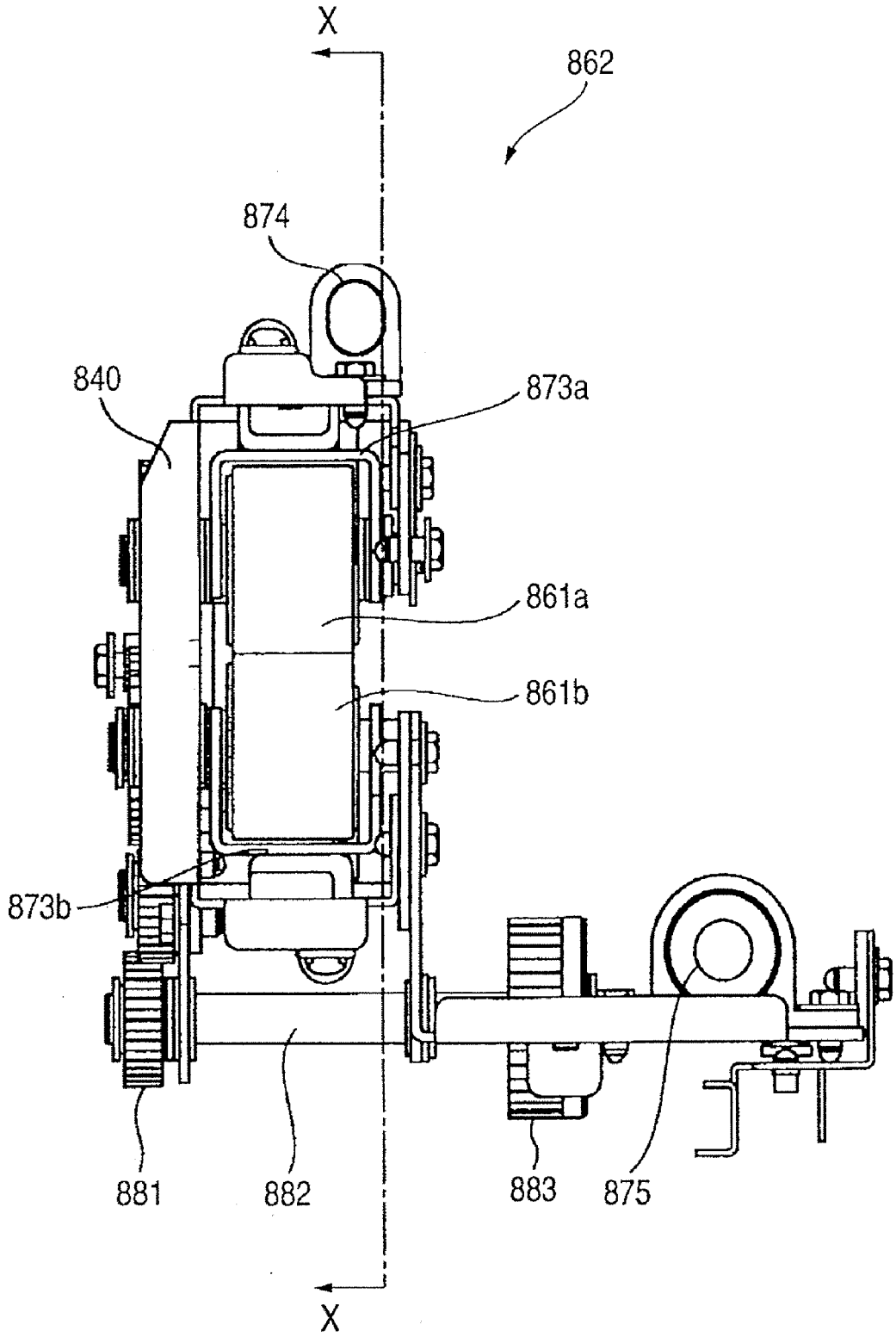
FIG. 8 is a front view of the press holder.
Figure 9:
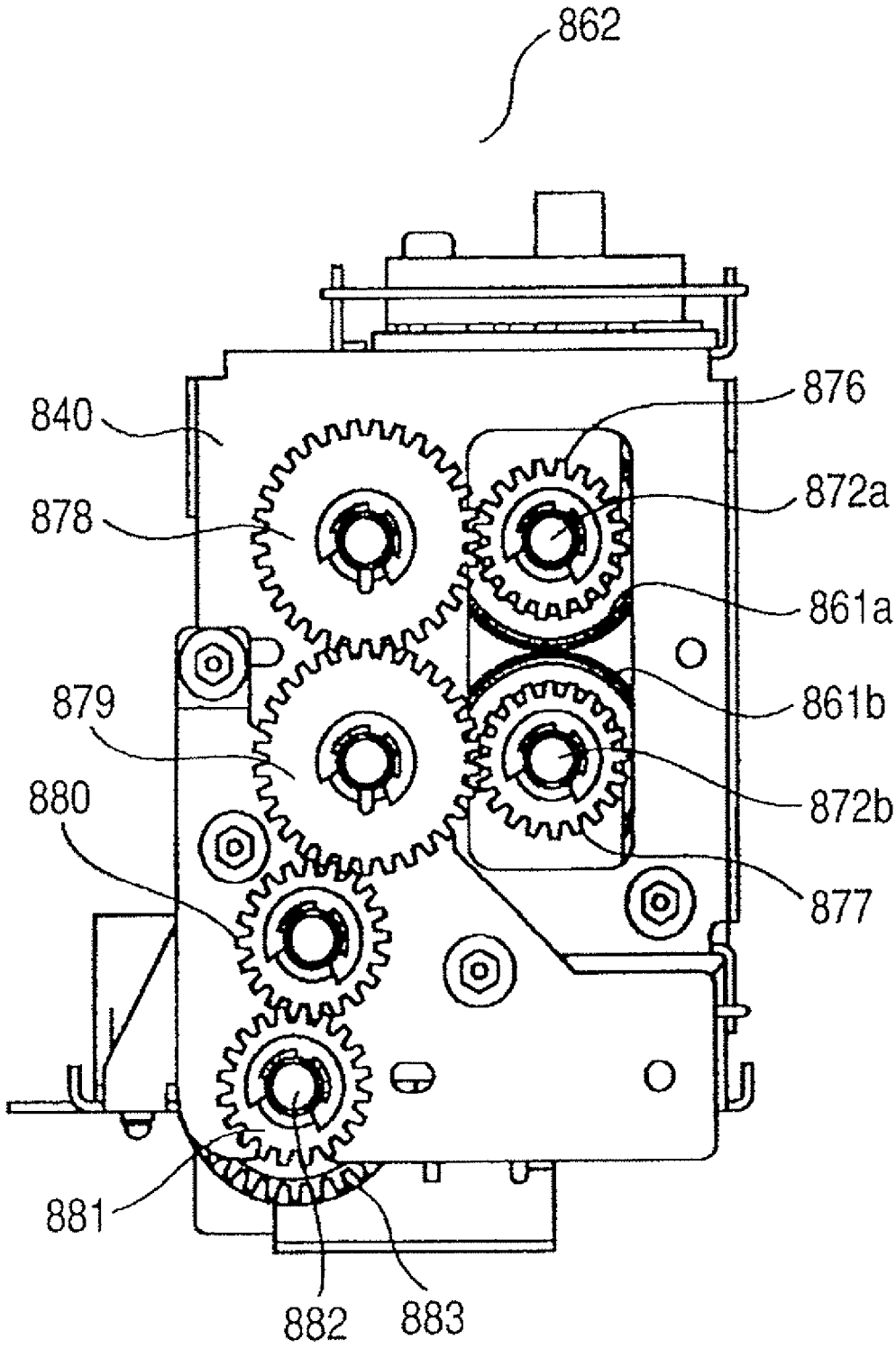
FIG. 9 is a view of the press holder viewed from a direction of the arrow B shown in FIG. 2.
Figure 10:
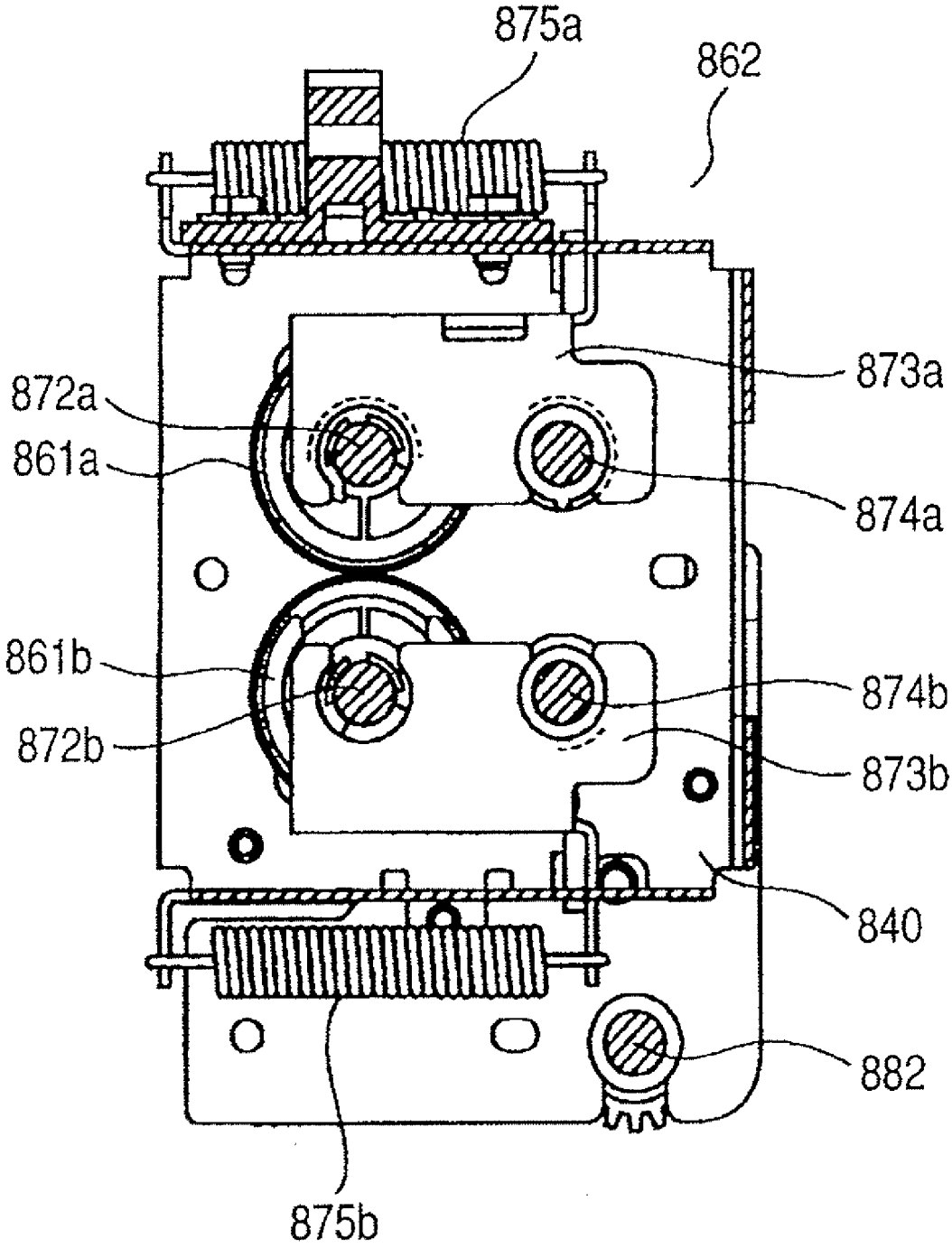
FIG. 10 is a cross-sectional view of the press holder taken along a line X-X shown in FIG. 8.

Next, the press holder 862 will be described with reference to FIGS. 7 to 10. Note that FIG. 7 is a perspective view of the press holder 862, FIG. 8 is a front view thereof, FIG. 9 is a view of the press holder 862 viewed from a direction of the arrow B shown in FIG. 2, and FIG. 10 is a cross-sectional view of the press holder taken along a line X-X shown in FIG. 8. While the press holder 862 is mounted with a sheet guide 871 with respect to the pair of press rollers 861, the sheet guide 871 is dismounted herein as shown in FIGS. 7 to 10.

The press holder 862 includes a frame 840 to which the slide bearings 874 and 875 are screw-fastened. In addition, rollers 861*a* and 861*b* of the pair of press rollers 861 are fixed onto roller shafts 872*a* and 872*b*, respectively, and are rotatably supported by press arms 873*a* and 873*b* through the bearings. An axial direction of the pair of press rollers 861 intersects with the fold line of the folded sheet.

Here, the press arms 873*a* and 873*b* are supported by rotating shafts 874*a* and 874*b* shown in FIG. 10 which are fixed onto the frame 840 through the bearings. Tension springs 875*a* and 875*b* are respectively provided between each one end portion of the press arms 873*a* and 873*b* and the frame 840. By the tension springs 875*a* and 875*b*, the rollers 861*a* and 861*b* of the pair of press rollers 861, which can be brought into contact with each other or separated from each other, are brought in press-contact with each other in a direction in which the rollers 861*a* and 861*b* come closer to each other.

When the sheet bundle is inserted into the pair of press rollers 861, the press arms 873*a* and 873*b* each rotate with the rotating shafts 874*a* and 874*b* as a fulcrum against a spring force of the tension springs 875*a* and 875*b*. As a result, the rollers 861*a* and 861*b* of the pair of press rollers 861 are separated from each other.

To one end portion of each of the roller shafts 872*a* and 872*b*, gears 876 and 877 are fixed at positions where the gears 876 and 877 run out of the frame 840 as shown in FIG. 9. Further, gears 880, 879, and 878 are rotatably supported with respect to the frame 840 in such a manner that the gears 880, 879, and 878 are engaged with each other in the stated order. That is, the gear 878 is engaged with the gear 876, and the gear 879 is engaged with the gear 877, respectively.

In addition, the gear 880 is engaged with a gear 881 which is fixed onto a gear shaft 882 and supported through a bearing (not shown) with respect to the frame 840. Note that a gear 883 is fixed onto the other end portion of the gear shaft 882 as shown in FIG. 8, and when the gear 883 rotates, the rollers 861*a* and 861*b* of the pair of press rollers 861 each rotate by the drive transferred through a gear train. In this case, the rotation directions of the rollers 861*a* and 861*b* of the pair of press rollers 861 are opposite to each other so that the directions becomes the same with respect to the nipped sheet.

Further, the gear 883 is engaged with a rack gear 841 which extends to be in parallel with the slide shafts 864 and 865 shown in FIGS. 3 to 5 and is fixed onto the base sheet metal 863. Therefore, when the press holder 862 moves while being supported by the slide shafts 864 and 865 in accordance with the movement of the timing belt 868 by the rotation of the motor M6 (see FIG. 3), the gear 883 rotates while being engaged with the rack gear 841.

As a result, the drive is also transferred to the pair of press rollers 861, so the rollers 861*a* and 861*b* of the pair of press rollers 861 rotate in opposite directions, respectively. In other words, the pair of press rollers 861 are rotated by the driving force of the motor M6 constituted of the gear 883 and the rack gear 841 provided to the press holder 862. The driving force of the motor M6 is transferred through, for example, a second drive transfer part 892 shown in FIG. 4.

As shown in FIG. 4, drive transfer means 890 includes first and second drive transfer parts 891 and 892, and the driving force of the motor M6 serving as the drive source is transferred to the pair of press rollers 861 and the press holder 862 by the drive transfer means 890. Herein, gear trains of the first and second drive transfer parts 891 and 892 are set such that the movement speed of the press holder 862 and the circumferential speed of each of the rollers 861*a* and 861*b* of the pair of press rollers 861 become the same speed.

In other words, the fold-line press unit 860 is constituted in such a manner that the rollers 861*a* and 861*b* of the pair of press rollers 861 are integrated with the press holder 862 to be rotated in opposite directions from each other by the rotation of the motor M6, at the circumferential speed which is set to be equal to the movement speed of the press holder 862. Thus, the rollers 861*a* and 861*b* of the pair of press rollers 861 are driven by a single, in other words, the common motor M6, thereby making it possible to simplify the structure of the finisher 500 and reduce the manufacturing cost thereof.

In addition, the rollers 861*a* and 861*b* of the pair of press rollers 861 are driven by the drive transfer means 890, thereby improving strand performance of the pair of press rollers 861 with respect to the folded sheet.

In this embodiment, when the folded sheet bundle (hereinafter, referred to as "center-folded sheet bundle") is subjected to a creasing process through the pair of press rollers 861, the center of the center-folded sheet bundle in the conveying direction is nipped irrespective of the size of the bundle to be creased, thereby maintaining the center-folded sheet bundle to be stopped by one of more than roller pairs.

To be specific, the nip pressure F3 of the pair of second folding conveying rollers 812 is applied to the leading edge side of the center-folded sheet bundle, the nip pressure F2 of the pair of folding conveying rollers 811 is applied to the trailing edge side of the center-folded sheet bundle, and at the same time, the nip pressure F1 of the pair of folding rollers 810 is also applied depending on the size (i.e., length in the conveying direction) of the center-folded sheet bundles. As a result, when the center-folded sheet bundle is nipped by the pair of press rollers 861, even in a case where a torque is generated, it is possible to hold down the center-folded sheet bundle with efficiency.

It should be noted that a stopping position for the leading edge (i.e., press leading edge position) of the centered-folded bundle during the creasing process is controlled by utilizing a sensor 884 provided to the bundle conveying guide 814 shown in FIG. 2 so that a relative relation with the pair of press rollers 861 becomes constant.

Figure 15:
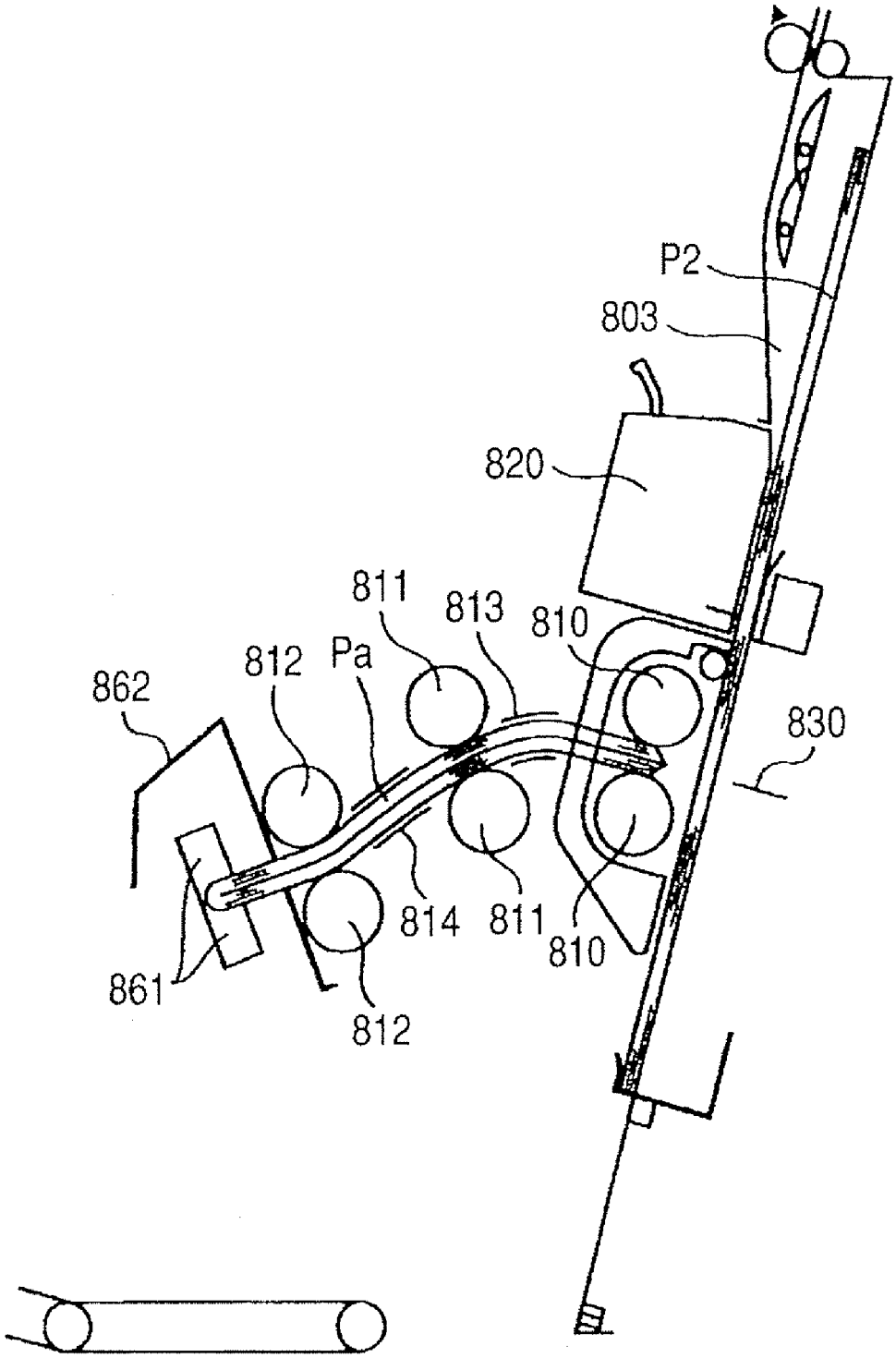
FIG. 15 is a fourth diagram for explaining the bookbinding operation of the sheet processing apparatus.

On the other hand, a stopping position for the trailing edge (i.e., press trailing edge position) of the centered-folded bundle during the creasing process is regulated by, for example, the pair of folding rollers 810 to be described later as shown in FIG. 15, and arrangement of the respective portions is determined so that the two trailing edges have postures in such a direction that the two trailing edges are made apart from each other. Accordingly, during the creasing process of the center-folded sheet bundle through the pair of press rollers 861, there is no possibility of giving a curl caused in a direction where the two trailing edges of the center-folded sheet bundles are opened.

Further, the arrangement of the respective portions is determined so that the press trailing edge position is located out of the area of the containing guide 803 as shown in FIG. 15. Therefore, also during the creasing process through the pair of press rollers 861, it is possible to contain the subsequent sheet bundle into the containing guide 803, and perform alignment operation. Further, with such the structure, it is possible to improve the productivity of the apparatus.

The arrangement of the respective portions is determined so that a linear distance between the press trailing edge position of the center-folded sheet bundle having a largest size which is subjected to the creasing process, and the press leading edge position is shorter than the length of the center-folded sheet bundle in the conveying direction. As a result, the bundle conveying guides 813 and 814 has such a gently curved shape that the curl is not given to the center-folded sheet bundle.

Further, the bundle conveying guides 813 and 814 are arranged such that the bundle conveying guides 813 and 814 and the press holder 862 are contained in a space between the containing guide 803 and the trailing edge guide 710. With such the structure, the folded bundle discharge tray 850 and the fold-line press unit 860 are arranged to spatially overlap each other, thereby enabling reduction in size of the finisher 500 in the conveying direction.

FIG. 11 is a control block diagram of the copying machine 1000. A CPU circuit portion 150 includes a CPU (not shown). The CPU circuit portion 150 controls a document feeder controller 101, an image reader controller 201, an image signal controller 202, a printer controller 301, a folding process controller 401, a finisher controller 501, and an external I/F 203 according to a control program stored in a ROM 151 and settings by the operation portion 1.

Here, the document feeder controller 101 controls the document feeding portion 100, the image reader controller 201 controls the image reader portion 200, the printer controller 301 controls the printer unit 300, and the folding process controller 401 controls the folding process part 400. In addition, the finisher controller 501 controls operations performed by the staple portion 600, the saddle stitch binding portion 800, the inserter 900, and the like of the finisher 500.

Further, the operation portion 1 includes a plurality of keys for setting a variety of functions relating to the image formation, and a display part for displaying a set state. A key signal corresponding to each key operation performed by the user is outputted to the CPU circuit portion 150, and at the same time, the corresponding information is displayed on the display part in response to the signal sent from the CPU circuit portion 150.

A RAM 152 is used as an area for temporarily holding control data or as a work area for calculation related to the control. The external I/F 203 is an interface between the copying machine 1000 and an external computer 204, and develops print data from the computer 204 into a bit-mapped image to output the bit-mapped image to the image signal controller as image data.

The image formed on the document, which is read by the an image sensor (not shown), is outputted to the image signal controller 202 from the image reader controller 201. The printer controller 301 outputs the image data from the image signal controller 202 to an exposure control part (not shown).

Next, a saddle stitch binding process performed by the saddle stitch binding portion 800 according to this embodiment will be described.

When the user sets a saddle stitch binding mode, a sheet P having an image formed thereon is appropriately and sequentially discharged from the pair of discharge rollers 118 of the printer unit 300. Then, the sheet P first passes through the folding process part 400, is transferred to the pair of entrance rollers 501, and then advances to the lower discharge path 522 through the conveying path 520.

Figure 12:
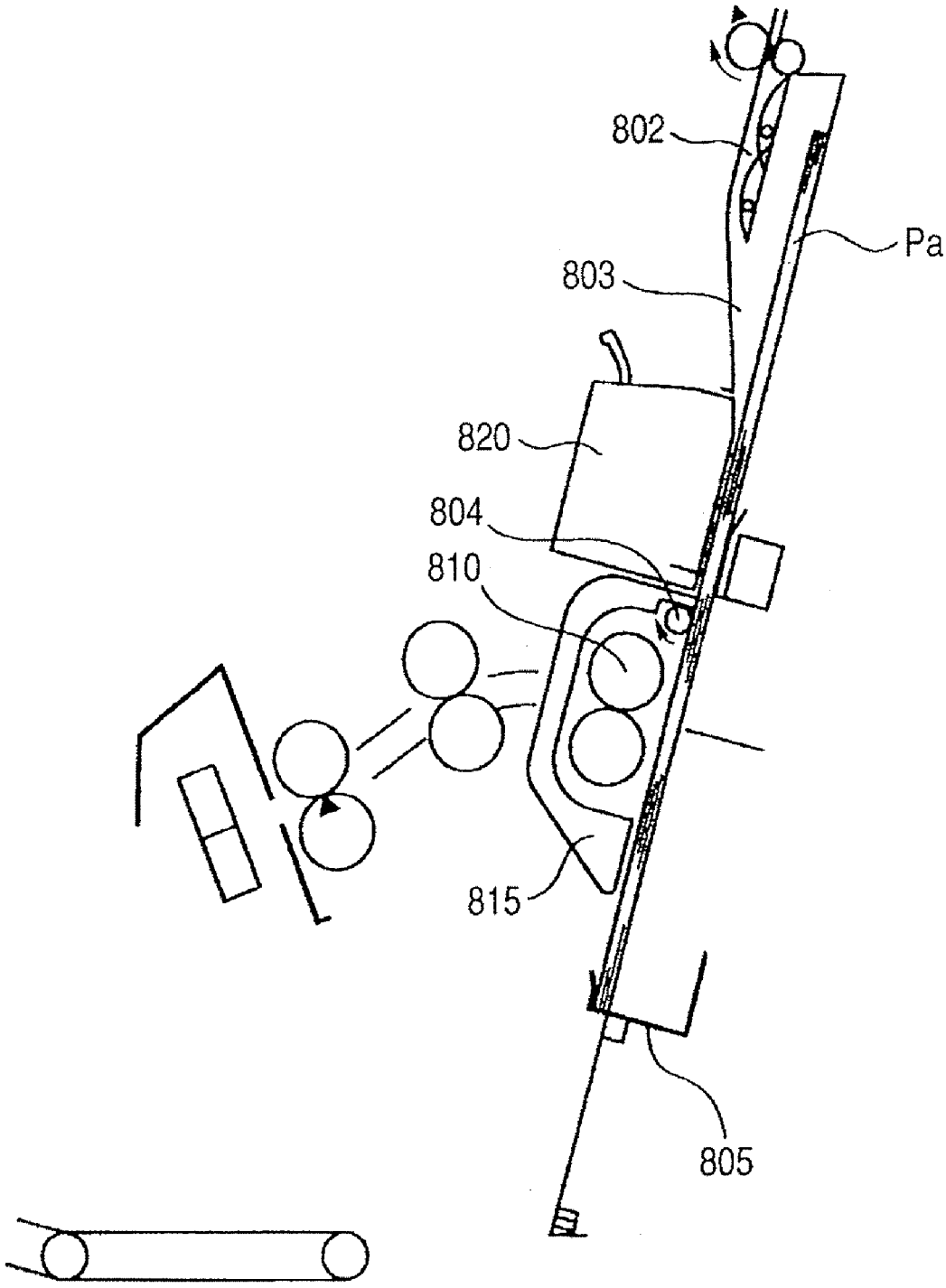
FIG. 12 is a first diagram for explaining a bookbinding operation of the sheet processing apparatus.

After that, the sheet P is guided into the saddle discharge path 523 by the switching flapper 514 provided for the lower discharge path 522. Then, as shown in FIG. 12, the sheet P is discharged onto the containing guide 803 while being guided by the flapper 802 according to the sheet size, and is allowed to abut against the sheet positioning member 805 which is stopped in advance at a position appropriate for the sheet size while receiving a conveying force of the slide roller 804.

As a result, the positioning of the sheet P in the conveying direction is performed, and then the sheet P is aligned by being caught in between the pair of alignment plates 815 that are on standby at a position where the pair of alignment plates do not interfere with the sheet discharge at the time of the sheet discharge, thereby also performing the positioning of the sheet P in the width direction. The above-mentioned sheet containing and alignment operations are performed every time the sheet P is discharged.

Figure 13:
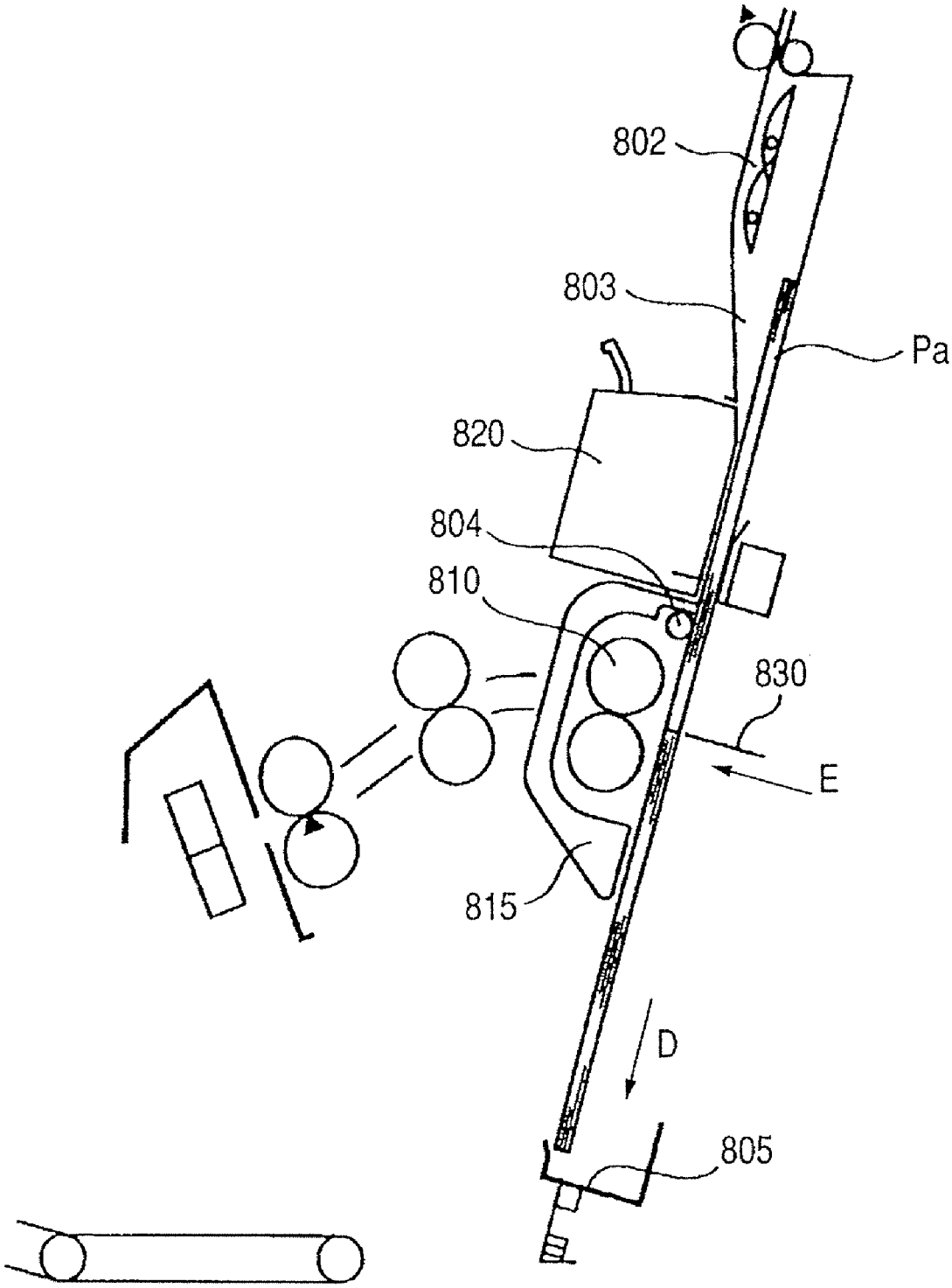
FIG. 13 is a second diagram for explaining the bookbinding operation of the sheet processing apparatus.

Next, when the alignment of the last sheet is completed, the middle portion of the center-folded sheet bundle Pa in the conveying direction is stapled by the stapler 820. Upon completing the stapling, the sheet positioning member 805 is allowed to descend. Then, with the descent of the sheet positioning member 805, the center-folded sheet bundle Pa moves downward (i.e., in a direction indicated by the arrow D) as shown in FIG. 13. After that, the sheet positioning member 805 stops at a central portion of the center-folded sheet bundle Pa, that is, a position where the staple portion corresponds to the nip between the pair of folding rollers 810.

Figure 14:
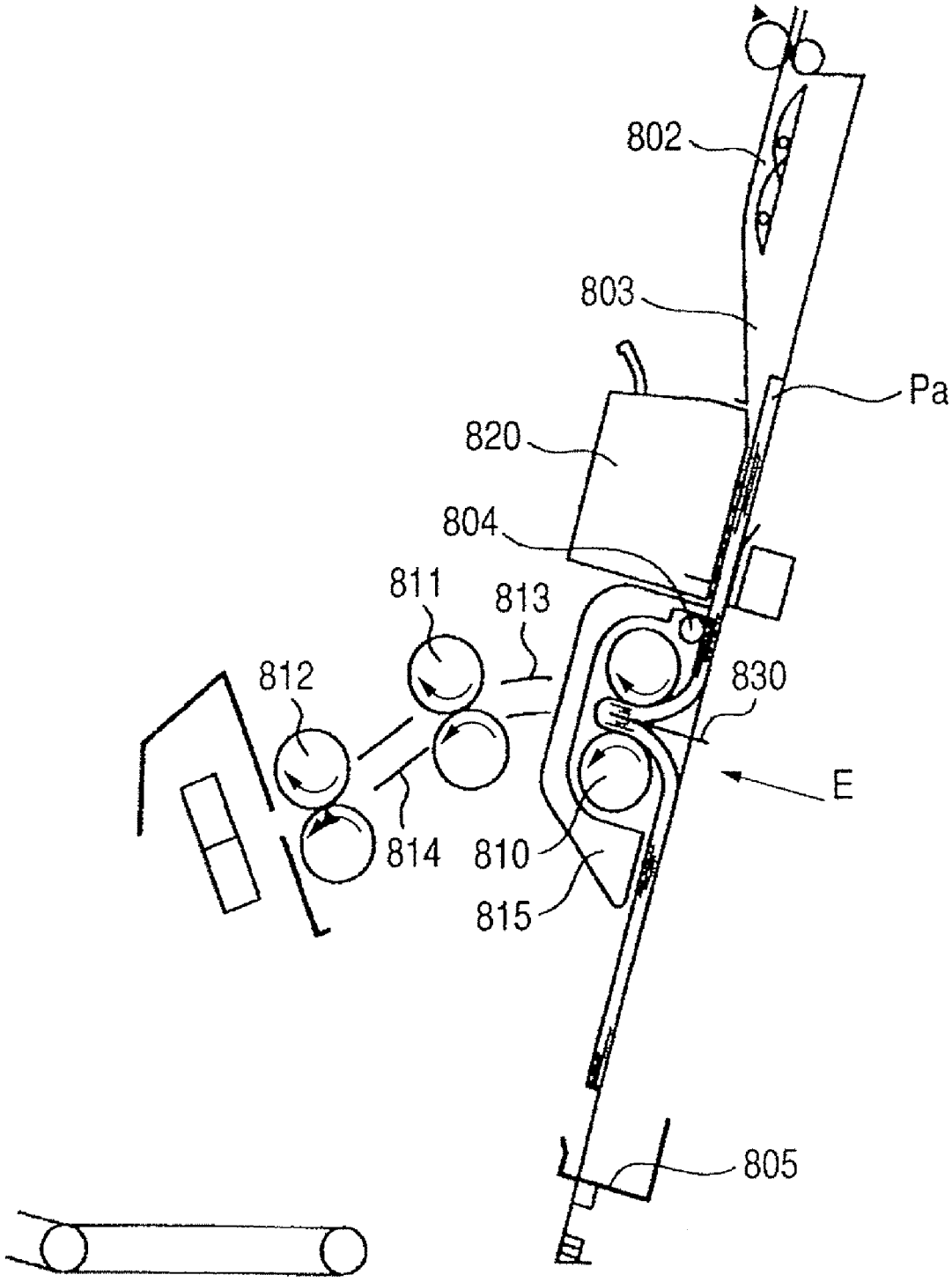
FIG. 14 is a third diagram for explaining the bookbinding operation of the sheet processing apparatus.

Next, the thrust member 830 that is on standby at a standby position is allowed to move in a direction indicated by the arrow E, and the center-folded sheet bundle Pa is folded by inserting the middle portion of the center-folded sheet bundle Pa into the nip between the pair of folding rollers 810 while pressing the pair of folding rollers 810 to be opened as shown in FIG. 14.

In this case, the pair of folding rollers 810 are rotated in the direction indicated by the arrow by the motor M4 (see FIG. 2) together with the pairs of first and second folding conveying rollers 811 and 812. The center-folded sheet bundle Pa, which is the folded sheet bundle, is conveyed within the bundle conveying guides 813 and 814 with the fold line as the leading edge. As shown in FIG. 15, the center-folded sheet bundle Pa is conveyed to the position where the fold line is allowed to be nipped by the pair of press rollers 861, thereby stopping the motor M4.

At this time, as described above, the center-folded sheet bundle Pa is nipped by the center in the conveying direction such that the leading edge portion is held by the pair of second folding conveying rollers 812 and the trailing edge portion is held by the pair of folding conveying rollers 811, and also reliably held by the pair of folding rollers 810 in some center-folded sheet bundles having a certain size (i.e., length in the conveying direction). Upon completing the thrusting, the thrust member 830 moves to the standby position again.

Figure 16:
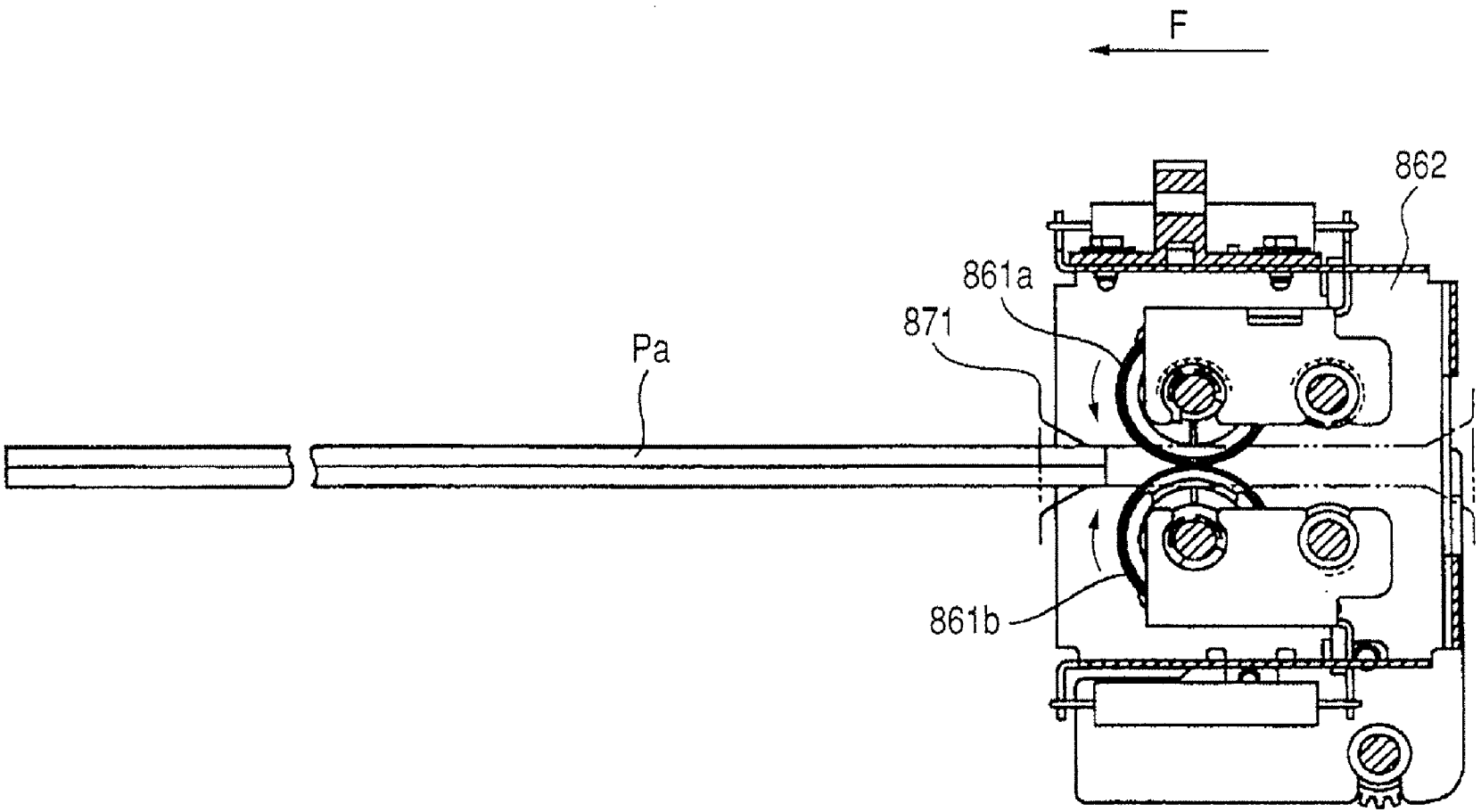
FIG. 16 is a first diagram for explaining a creasing process of the press unit.

Here, prior to the above-mentioned conveying of the center-folded sheet bundle Pa, the press holder 862 stands by at the standby position (i.e., at the back side) according to the size (i.e., in the width direction) of the center-folded sheet bundle Pa as shown in FIG. 16. When the fold line of the center-folded sheet bundle Pa is inserted into the sheet guide 871 (as indicated by the chain dash) upon completion of the stopping of center-folded sheet bundle Pa, the press holder 862 starts moving to the front side (in a direction indicated by the arrow F) while rotating the pair of press rollers 861 by the driving force of the motor M6.

Figure 17:
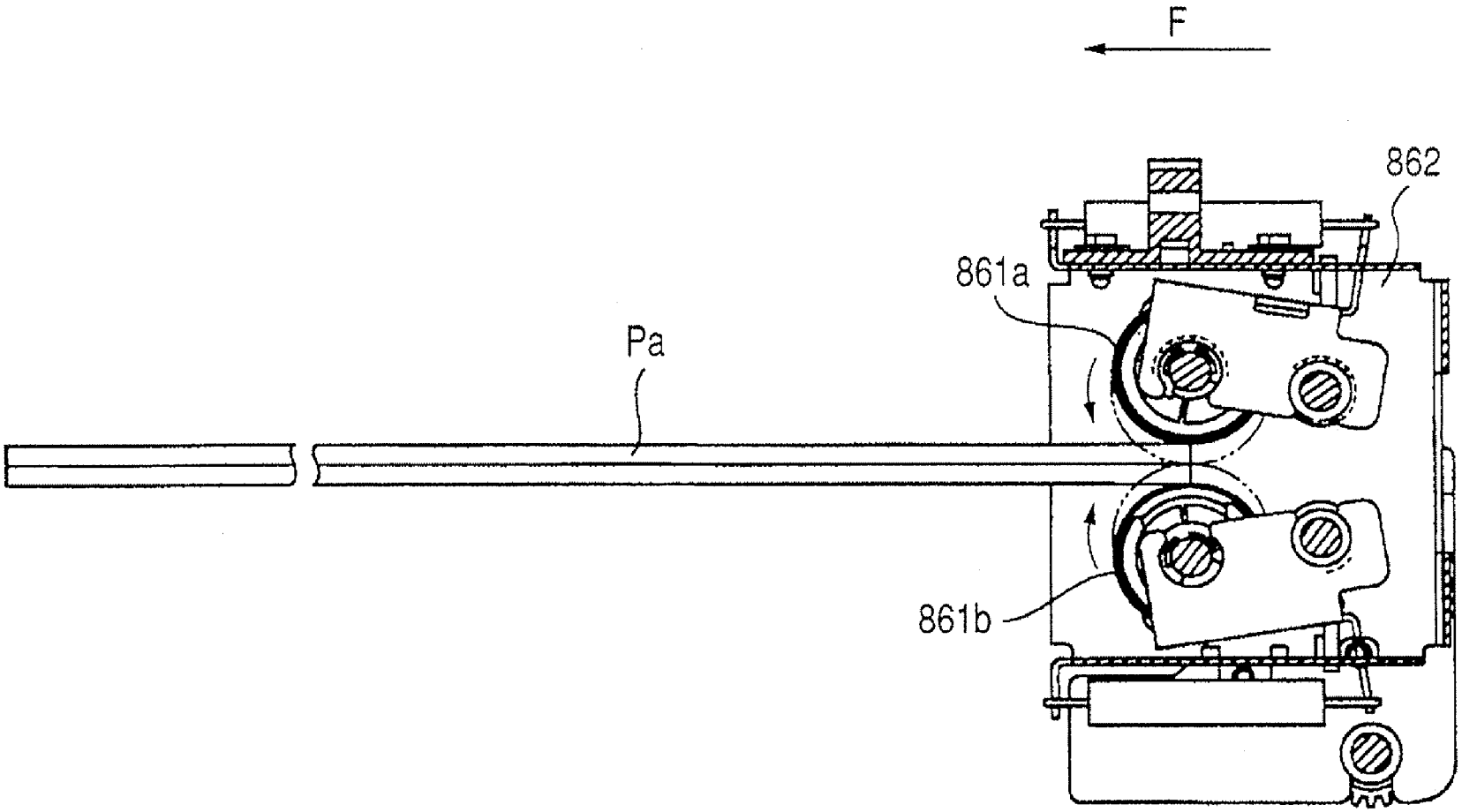
FIG. 17 is a second diagram for explaining the creasing process of the press unit.

After that, the rollers 861*a* and 861*b* of the pair of press rollers 861 each are allowed to abut against the side surfaces of the center-folded sheet bundle Pa that is stopped and held. At this time, the rollers 861*a* and 861*b* each rotate in the direction indicated by the arrows, thereby making it possible to nip the fold line by smoothly moving over the side edges of the center-folded sheet bundle Pa as shown in FIG. 17. As a result, it is possible to nip the center-folded sheet bundle Pa without delay of response in synchronization with the movement of the press holder 862. Note that the operation is not changed even when the thickness of the center-folded sheet bundle Pa is increased.

As described above, it is possible to nip the center-folded sheet bundle Pa by the pair of press rollers 861 without delay of response in synchronization with the movement of the press holder 862, thereby making it possible to prevent a wrinkle, a rip, or a damage such as a trace of a roller with respect to the center-folded sheet bundle Pa.

When the pair of press rollers 861 moves over the fold line of the center-folded sheet bundle Pa, the torque is applied to the center-folded sheet bundle Pa. However, the center-folded sheet bundle Pa is reliably held by the plurality of pairs of rollers on a long clock as described above, so the center-folded sheet bundle Pa is not inclined or moved. Also, because of this, it is possible to nip the center-folded sheet bundle Pa without causing a wrinkle, a rip, or a damage such as a trace of a roller with respect to the center-folded sheet bundle Pa.

In addition, the press holder 862 and the pair of press rollers 861 are driven by the motor M6, which is the common drive source, thereby making it possible to match the respective speeds of the press holder 862 and the pair of press rollers 861 with the simple structure as compared with a case where a plurality of motors are used.

Figure 18:
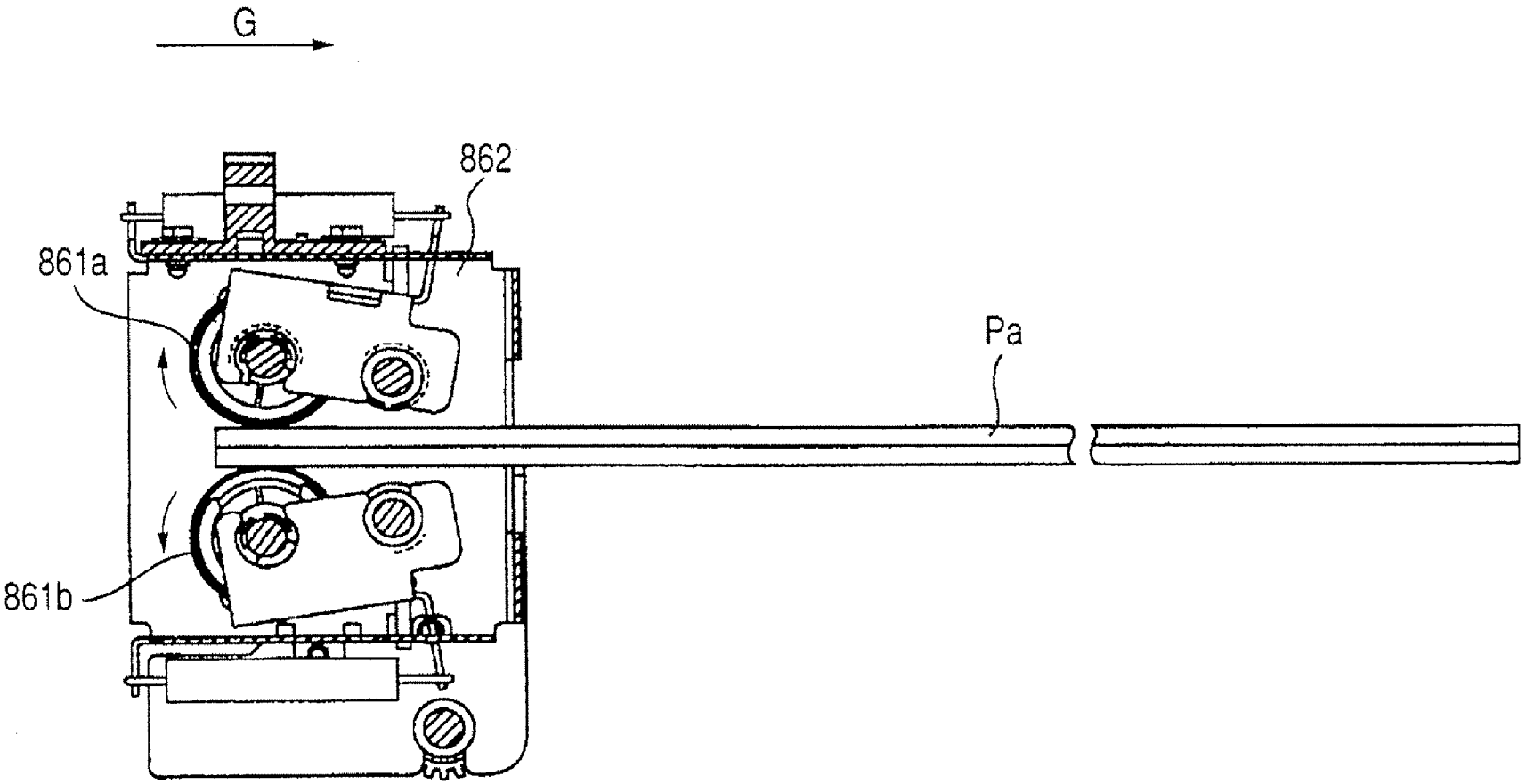
FIG. 18 is a third diagram for explaining the creasing process of the press unit.

Next, the pair of press rollers 861 which moves over the fold line of the center-folded sheet bundle Pa as described above, continues to move while pressing the fold line, and then stops when the pair of press rollers 861 reaches a front position in the other edge of the center-folded sheet bundle Pa. After that, the pair of press rollers 861 starts moving in a direction indicated by the arrow G shown in FIG. 18 by the reverse rotation of the motor M6, and then returns to the back side again.

By such the reciprocating operation of the press holder 862 and the pair of press rollers 861, the fold line is reinforced. Herein, the number of reciprocation times of the pair of press rollers 861 may be changed according to the size, the number of sheets, the thickness, and the image information (e.g., amount of toner adhering to the sheet) of the center-folded sheet bundle Pa. For example, in some sheet bundles that are difficult to be creased, it is possible to improve folding performance by increasing the number of reciprocation times. Note that the number of reciprocation times is preset based on experimental results.

In a case where the reciprocating operation of the pair of press rollers 861 is performed a plurality of times, the switching in the movement direction is performed on the portion of the fold line which is close to the edge portion of the center-folded sheet bundle Pa. As a result, it is not necessary for the pair of press rollers 861*a* to move over the center-folded sheet bundle Pa many times, thereby reducing the damage on the center-folded sheet bundle Pa. Also, the movement distance is shortened, so the productivity of the apparatus is enhanced.

In conjunction with the switching of the movement direction, the pair of press rollers 861 changes the rotation direction. Further, the movement speed of the press holder 862 is always mechanically synchronized with the circumferential speed of the pair of press rollers 861. As a result, the surface of the center-folded sheet bundle Pa is not damaged when the switching of the movement direction is performed.

On the other hand, in the creasing process performed by the pair of press rollers 861, the trailing edge of the center-folded sheet bundle Pa is located out of the area of the containing guide 803 as shown in FIG. 15. Therefore, when there is a bundle P2 to be subsequently processed, the printer unit 300 continuously performs image formation without stopping, thereby making it possible to perform the sheet containing and alignment operations in parallel with the previous creasing process. In addition, the trailing edge of the bundle, which is stopped during the creasing process, is contained in the bundle conveying guide 813 such that the trailing edges of the sheets overlap each other, so the curl does not occur also in the direction where the sheets are apart from each other.

Figure 19:
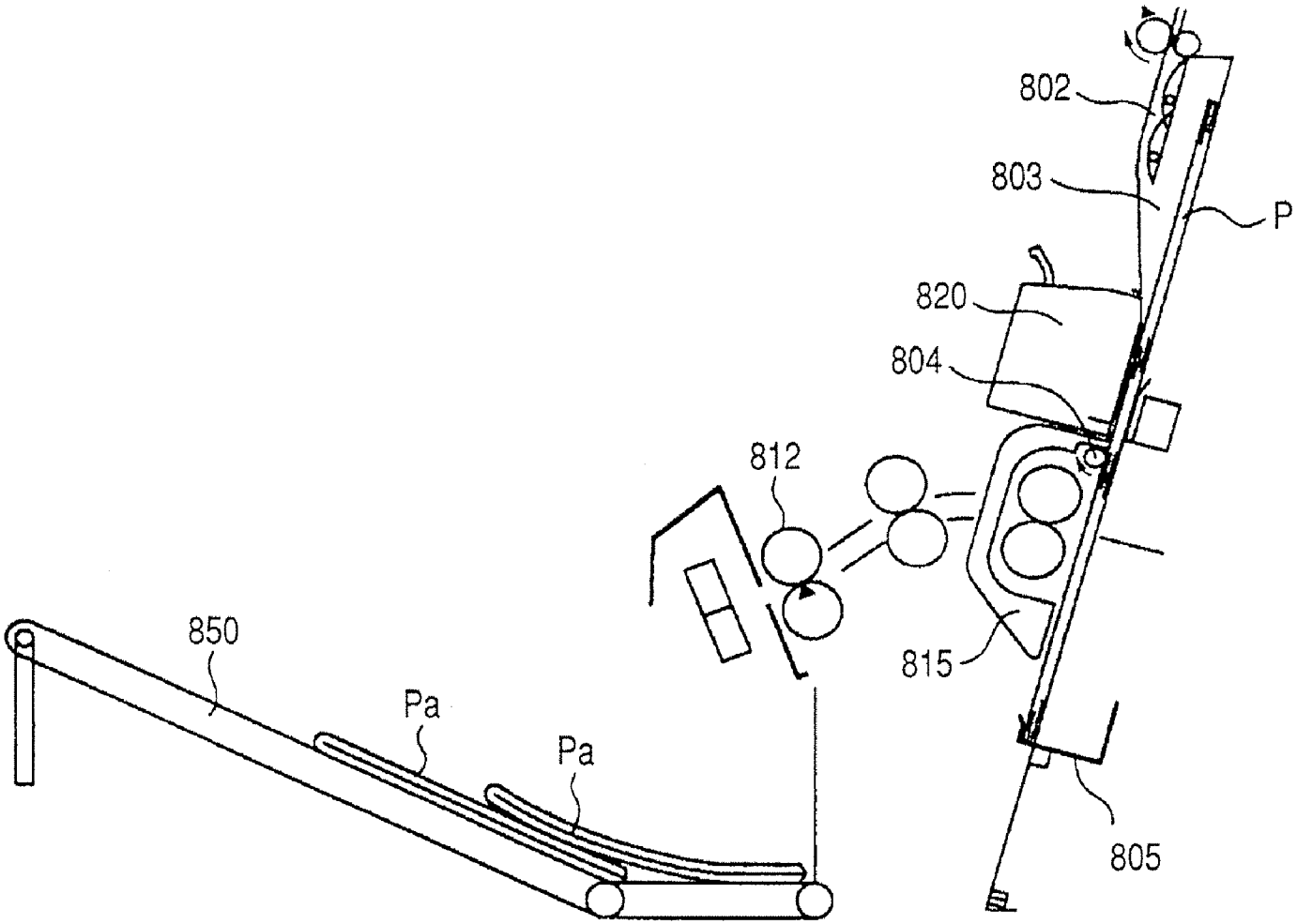
FIG. 19 is a fifth diagram for explaining the bookbinding operation of the sheet processing apparatus.
Figure 20:
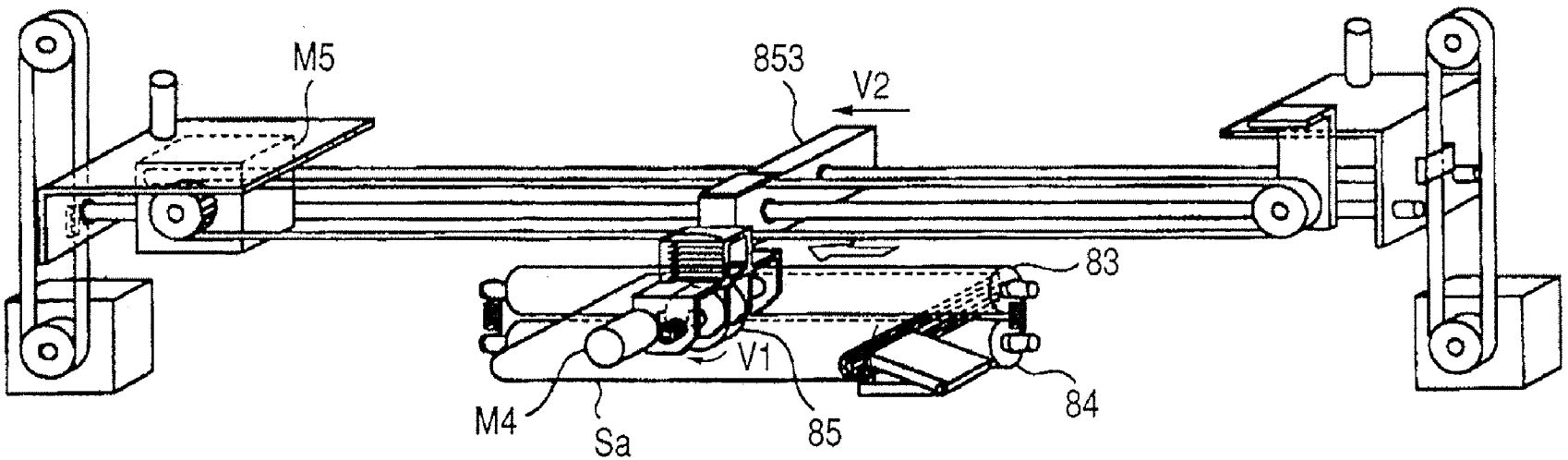
FIG. 20 is an explanatory view of a structure for the creasing process of a conventional sheet processing apparatus.
Figure 21A:
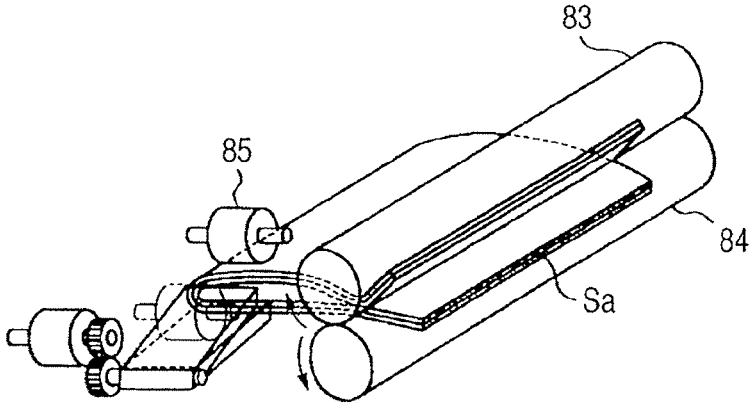
FIGS. 21A, 21B, and 21C are explanatory views of the creasing process of the conventional sheet processing apparatus.
Figure 21B:
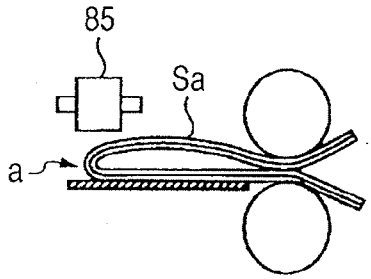
Figure 21C:
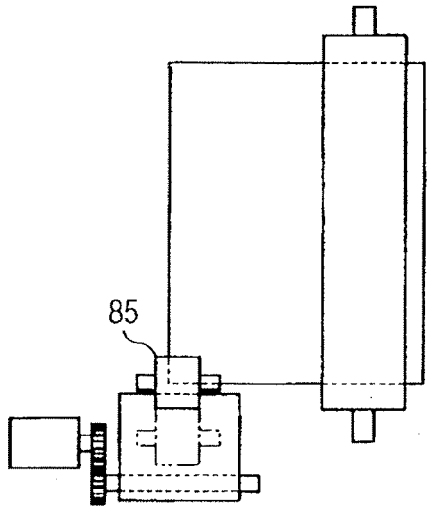

Next, upon completing the above-mentioned creasing process by the pair of press rollers 861, the press holder 862 moves to the home position, and opens the path in the conveying direction of the center-folded sheet bundle Pa. After that, the motor M4 is driven, the conveyance of the center-folded sheet bundle Pa which has been stopped is restarted, thereby discharging the center-folded sheet bundle Pa onto the folded bundle discharge tray 850 by the pair of second folding conveying rollers 812 as shown in FIG. 19. At this time, the fold line of the discharged center-folded sheet bundle Pa is reinforced as described above, and is received on the folded bundle discharge tray 850 while the trailing edge portions are closed.

By repeating the above-mentioned operations, it is possible to obtain a desired number of bundles on the folded bundle discharge tray 850. The folding performance of each of the center-folded sheet bundles Pa is improved by the above-mentioned creasing process, with the result that the alignment quality on the folded bundle discharge tray 850 is also enhanced.

As described above, the pair of press rollers 861, which rotate along the fold line while pressing the fold line of the center-folded sheet bundle Pa, are driven by the motor M6 serving as the common drive source, thereby making it possible to simplify the structure of the apparatus and lower the manufacturing cost of the apparatus.

In addition, the drive transfer means 890 for transferring a driving force from the motor M6 to the pair of press rollers 861 and the press holder 862 is constituted such that the movement speed of the press holder 862 is set to be equal to the circumferential speed of the pair of press rollers 861, thereby making it possible to perform the creasing process without damaging the center-folded sheet bundle Pa.

Further, the pair of press rollers 861 is reversely rotated by the drive transfer means 890 in conjunction with the reverse rotation of the press holder 862, thereby making it possible to perform the switching in the movement direction of the press holder 862 while the movement speed of the press holder 862 is synchronized with the circumferential speed of the pair of press rollers 861 without performing a complicated soft control.

According to this embodiment, pressing means, which rotates along the fold line while pressing the fold line of the folded sheet bundle by the common drive source, is driven by the common drive source. Therefore, it becomes possible to simplify the structure of the apparatus and lower the manufacturing cost of the apparatus. In addition, drive transfer means, which transfers the drive from the common drive source to pressing means and hold means, is constituted such that the movement speed of the hold means is set to be equal to the circumferential speed of the pressing means. Therefore, it is possible to perform the creasing process without damaging the folded sheet bundle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265418, filed Sep. 13, 2005, which is hereby incorporated by reference herein in its entirety.

What is claimed is:

1. A sheet processing apparatus for processing a sheet bundle, comprising:

a pair of press rollers which rotate along a fold line of a folded sheet while nipping the fold line of the folded sheet, and which are separably brought into pressure-contact with each other;

a holder movable along the fold line of the folded sheet, which holds the pair of press rollers;

a common drive source which drives the pair of press rollers and moves the holder; and a drive transfer part which transfers a drive from the common drive source to each press roller of the pair of press rollers and to the holder, wherein the drive transfer part is constituted such that a movement speed of the holder is set to be equal to a circumferential speed of the pair of press rollers.

2. A sheet processing apparatus according to claim 1, wherein the drive transfer part comprises:

a first drive transfer part which moves the holder by the drive from the common drive source; and a second drive transfer part which rotates the pair of press rollers at the circumferential speed set to be equal to the movement speed of the holder in accordance with movement of the holder.

3. A sheet processing apparatus according to claim 1, wherein:

the holder is reciprocatingly movable; and the pair of press rollers is reversely rotated in conjunction with switching of a movement direction of the holder.

4. A sheet processing apparatus according to claim 3, wherein the switching of the movement direction of the holder is performed in a state where the pair of press rollers presses the hold line of the sheet.

5. A sheet processing apparatus according to claim 1, further comprising at least two conveying portions which convey the folded sheet to the pair of press rollers, and fixing both edge portions of the folded sheet in a direction perpendicular to the fold line when the pair of press rollers rotates along the fold line of the sheet.

6. An image forming apparatus, comprising:

an image forming portion which forms an image on a sheet; and the sheet processing apparatus according to claim 1 for processing a sheet bundle by folding the sheet having an image formed thereon by the image forming portion.

7. A sheet processing apparatus which process a sheet, comprising:

a pair of press rollers which rotate along a fold line of a folded sheet while nipping the fold line of the folded sheet, and which are separably brought into pressure-contact with each other;

a holder movable along the fold line of the folded sheet, which rotatably holds the pair of press rollers;

a motor;

a first drive transfer part which transfers a rotation of the motor to move the holder; and a second drive transfer part which transfers the rotation of the motor to rotate each press roller of the pair of press rollers.

8. A sheet processing apparatus according to claim 7, wherein a movement speed of the holder which is obtained by transferring the rotation of the motor by the first drive transfer part is set to be equal to a circumferential speed of the pair of press rollers which is obtained by transferring the rotation of the motor by the second drive transfer part.

* * * * *